US007000767B2

(12) United States Patent
Tanaka et al.

(10) Patent No.: US 7,000,767 B2
(45) Date of Patent: Feb. 21, 2006

(54) STRUCTURE OF AIR-PACKING DEVICE HAVING IMPROVED SHOCK ABSORBING CAPABILITY

(75) Inventors: Yasuzumi Tanaka, Kawasaki (JP); Hidetoshi Koyanagi, Kashiwara (JP); Katsutoshi Yoshifusa, Lake Forest, CA (US)

(73) Assignee: AIR-PAQ, Inc., Lake Forest, CA (US)

( * ) Notice: Subject to any disclaimer, the term of this patent is extended or adjusted under 35 U.S.C. 154(b) by 0 days.

(21) Appl. No.: 10/854,576

(22) Filed: May 26, 2004

(65) Prior Publication Data

US 2005/0263425 A1 Dec. 1, 2005

(51) Int. Cl.
*B65D 81/02* (2006.01)

(52) U.S. Cl. ..... 206/522; 383/3

(58) Field of Classification Search ..... 206/522, 206/591, 592, 594; 383/3; 428/35.2, 35.7
See application file for complete search history.

(56) References Cited

U.S. PATENT DOCUMENTS 5,427,830 A * 6/1995 Pharo ..... 206/522
5,826,723 A 10/1998 Jaszai
5,857,571 A 1/1999 Tschantz et al.
5,901,850 A 5/1999 Jones et al.
5,996,798 A 12/1999 Gessert
6,076,677 A 6/2000 Pozzo
6,464,079 B1 10/2002 Newman
6,520,333 B1 * 2/2003 Tschantz ..... 206/522
6,629,777 B1 10/2003 Tanaka et al.
6,722,502 B1 4/2004 Newman
6,913,803 B1 * 7/2005 Peper ..... 206/522
2005/0109656 A1 * 5/2005 Ishizaki ..... 206/522
2005/0189257 A1 * 9/2005 Chen et al. ..... 206/522

* cited by examiner

*Primary Examiner*—Luan K. Bui
(74) *Attorney, Agent, or Firm*—Muramatsu & Associates

(57) ABSTRACT

An air-packing device has an improved shock absorbing capability to protect a product in a container box. The air-packing device is configured by first and second plastic films which are bonded at predetermined portions thereby creating a plurality of air containers, each of the air containers having a plurality of series connected air cells; a plurality of check valves established at inputs of the corresponding air containers for allowing compressed air to flow in a forward direction; an air input commonly connected to the plurality of check valves; and heat-seal flanges formed on side edges of the air-packing device. Through a post heat-seal treatment, predetermined points on the air containers and the heat-seal flanges are bonded, thereby creating a container portion having an opening for packing a product therein and a cushion portion for supporting the container portion when the air-packing device is inflated by the compressed air.

20 Claims, 21 Drawing Sheets

STRUCTURE OF AIR-PACKING DEVICE HAVING IMPROVED SHOCK ABSORBING CAPABILITY

FIELD OF THE INVENTION

This invention relates to a structure of an air-packing device for use as packing material, and more particularly, to a structure of an air-packing device having an improved shock absorbing capability for protecting a product from a shock or impact occurred in a channel of distribution by allowing flexible movement of the product packed in the air-packing device where the air packing device maintains the product in a substantially floating state therein while absorbing the shock before being applied to the product.

BACKGROUND OF THE INVENTION

In a distribution channel such as product shipping, a styroform packing material has been used for a long time for packing commodity and industrial products. Although the styroform package material has a merit such as a good thermal insulation performance and a light weight, it has also various disadvantages: recycling the styroform is not possible, soot is produced when it burns, a flake or chip comes off when it is snagged because of it's brittleness, an expensive mold is needed for its production, and a relatively large warehouse is necessary to store it.

Therefore, to solve such problems noted above, other packing materials and methods have been proposed. One method is a fluid container of sealingly containing a liquid or gas such as air (hereafter "air-packing device"). The air-packing device has excellent characteristics to solve the problems involved in the styroform. First, because the air-packing device is made of only thin sheets of plastic films, it does not need a large warehouse to store it unless the air-packing device is inflated. Second, a mold is not necessary for its production because of its simple structure. Third, the air-packing device does not produce a chip or dust which may have adverse effects on precision products. Also, recyclable materials can be used for the films forming the air-packing device. Further, the air-packing device can be produced with low cost and transported with low cost.

FIG. 1 shows an example of structure of an air-packing device in the conventional technology. The air-packing device 10*a* is composed of first and second thermoplastic films 13–14 and a check valve 11. Typically, each of the thermoplastic films 13–14 is composed of three layers of materials: polyethylene, nylon and polyethylene which are bonded together with appropriate adhesive. The first and second thermoplastic films 13–14 are heat-sealed together around rectangular edges (heat-seal portions) 12*a*, 12*b* after the check valve 11 is attached. Thus, one container bag 10*a* heat-sealed at the heat seal portions 12*a*, 12*b* is formed such as shown in FIG. 1.

FIGS. 2A–2B show another example of an air-packing device 10*b* with multiple air containers where each air container is provided with a check valve. A main purpose of having multiple air containers is to increase the reliability, because each air container is independent from the others. Namely, even if one of the air containers suffers from an air leakage for some reason, the air-packing device can still function as a shock absorber for packing the product because other air containers are intact.

In FIG. 2A, the air-packing device 10*b* is made of the first and second thermoplastic films noted above which are bonded together at a rectangular periphery 23*a* and further bonded together at each boundary 23*b* between two air containers 22 so that a guide passage 21 and two or more air containers 22 are created. When the first and second thermoplastic container films are bonded together, as shown in FIG. 2A, the check valves 11 are also attached to each inlet port of the air container 22. By attaching the check valves 11, each air container 22 becomes independent from the others. The inlet port 24 of the air-packing device 10*b* is used for filling an air to each air container 22 by using, for example, an air compressor.

FIG. 2B shows an example of the air-packing device 10*b* with multiple check valves when it is filled with the air. First, each air container 22 is filled with the air from the inlet port 24 through the guide passage 21 and the check valve 11. Typically, to avoid a rupture of the air containers 22 by variations in the environmental temperature, the air supplied to the air-packing device 10*b* is stopped when the air container 22 is inflated at about 90% of its full expansion rate. Typically, the air compressor has a gauge to monitor the supplied air pressure, and automatically stops supplying the air to the air-packing device 10*b* when the pressure reaches a predetermined value.

After filling the air, the expansion of each air container 22 is maintained because each check-valve 11 prevents the reverse flow of the air. The check valve 11 is typically made of two rectangular thermoplastic valve films which are bonded together to form an air pipe. The air pipe has a tip opening and a valve body to allow the air flowing through the air pipe from the tip opening but the valve body prevents the reverse air flow.

Air-packing devices are becoming more and more popular because of the advantages noted above. However, there is an increasing need to store and carry precision products or articles which are sensitive to shocks and impacts often involved in shipment of the products. For example, a personal computer such as a laptop computer includes a hard disc as a main data storage. Since the hard disc is a mechanical device with high precision, it must be protected from a shock, vibration, or other impact involved in the product distribution flow. There are many other types of product, such as wine bottles, DVD drivers, music instruments, glass or ceramic wares, etc. that need special attention so as not to receive a shock, vibration or other mechanical impact. Thus, there is a strong demand for air-packing devices that can minimize the amount of impact to the product when the product in a container box is dropped, collided or bumped against a wall, etc.

SUMMARY OF THE INVENTION

It is, therefore, an object of the present invention to provide a structure of an air-packing device for packing a product that can minimize a mechanical shock or vibration to the product when a container box carrying the product is dropped or collided.

It is another object of the present invention to provide a structure of an air-packing device that can be produced efficiently with low cost and can effectively absorb the impact to the product when the container box carrying the product is dropped or collided.

It is a further object of the present invention to provide a structure of an air-packing device that can easily form a cushion portion and a container portion for packing the product by a post heat-sealing treatment.

It is a further object of the present invention to provide a structure of an air-packing device that can easily form a double layer cushion portion and an opening for packing the product by a post heat-sealing treatment.

In one aspect of the present invention, the air-packing device for protecting a product therein is comprised of first and second thermoplastic films superposed with each other where predetermined portions of the first and second thermoplastic films are bonded, thereby creating a plurality of air containers, each of the air containers having a plurality of series connected air cells; a plurality of check valves established at inputs of the corresponding air containers between the first and second thermoplastic films for allowing the compressed air to flow in a forward direction; an air input commonly connected to the plurality of check valves to supply the compressed air to all of the series connected air cells through the check valves; and heat-seal flanges that are made of thermoplastic film and are formed on side edges close to both ends of the air-packing device. Through a post heat-seal treatment, predetermined points on the air containers are bonded with one another, and the heat-seal flanges are bonded with one another, thereby creating a container portion having an opening for packing a product therein and a cushion portion for supporting the container portion when the air-packing device is inflated by the compressed air.

The predetermined portions for bonding the first and second thermoplastic films include heat-seal lands each being formed at about a center of the air container to define the air cells where the heat-seal lands are folding points of the air-packing device when the air-packing device is inflated after the post heat-seal process. Each of the heat-seal lands forms two air flow passages at both sides thereof in the air container thereby allowing the compressed air to flow to the series connected air cells through the two air passages.

The predetermined portions for bonding the first and second thermoplastic films include heat-seal lands each being formed on a bonding line which air-tightly separates two adjacent air containers to define said air cells where heat-seal lands are folding points of the air-packing device when the air-packing device is inflated after the post heat-seal process. Each of the heat-seal lands forms an air flow passage at about a center of the air container thereby allowing the compressed air to flow to the series connected air cells through the air passage.

When packing a product to be protected in a container box, said cushion portion of the air-packing device contacts with an inner wall of the container box while the container portion of the air-packing device floatingly supports the product in the air without contacting with inner walls of the container box. The cushion portion has a triangular shape where the container portion is formed on a summit of the triangular shape of the cushion portion, and the air cell forming a base of the triangular shape contacts with the inner walls of the container box. Alternatively, the cushion portion has a pentagon shape where the container portion is formed on a summit of the pentagon shape of the cushion portion, and the air cells forming a base and sides of the pentagon shape contact with the inner walls of the container box.

In another aspect of the present invention, the air-packing device for protecting a product therein is comprised of first and second thermoplastic films superposed with each other where predetermined portions of the first and second thermoplastic films are bonded, thereby creating a plurality of air containers, each of the air containers having a plurality of series connected air cells; a plurality of check valves established at inputs of the corresponding air containers between the first and second thermoplastic films for allowing compressed air to flow in a forward direction; an air input commonly connected to the plurality of check valves to supply the compressed air to all of the series connected air cells through the check valves; and heat-seal flanges that are made of thermoplastic film and are formed on side edges close to both ends and intermediate positions of the air-packing device. Through a post heat-seal treatment, predetermined points on the air containers are bonded with one another, and the heat-seal flanges are bonded with one another, thereby creating two container portions facing with one another each having an opening for packing a product therein and two cushion portions at opposite ends of the air-packing device for supporting the container portions when the air-packing device is inflated by the compressed air.

In a further aspect of the present invention, the air-packing device for protecting a product therein is comprised of first and second thermoplastic films superposed with each other where predetermined portions of the first and second thermoplastic films are bonded, thereby creating a plurality of air containers, each of the air containers having a plurality of series connected air cells; a plurality of check valves established at inputs of the corresponding air containers between the first and second thermoplastic films for allowing compressed air to flow in a forward direction; an air input commonly connected to the plurality of check valves to supply the compressed air to all of the series connected air cells through the check valves; and heat-seal flanges that are made of at least one of first and second thermoplastic films and are formed on side edges of the air-packing device.

The air-packing device configured above in a sheet form is folded in a W-shape in cross section, and through a post heat-seal treatment, predetermined points on the air containers are bonded with one another, and the heat-seal flanges are bonded with one another, thereby creating a container portion having an opening for packing a product therein and a double layer cushion portion at an outer periphery of the container portion when the air-packing device is inflated by the compressed air.

According to the present invention, the air-packing device can minimize a mechanical shock or vibration to the product when a container box carrying the product is dropped or collided. The sheet form of the air-packing device is folded and the post heat-seal treatment is applied thereto, thereby creating a structure unique to a production to be protected. The air-packing device can easily form a cushion portion and a container portion for packing the product by a post heat-sealing treatment where the container portion floatingly supports the product in a container box to absorb the shock applied to the container box. The air-packing device having the double layer cushion portion has a further improved shock absorbing capability.

BRIEF DESCRIPTION OF THE DRAWINGS

FIG. 3A is a plan view showing a sheet like air-packing device and FIGS. 3B and 3C are cross sectional side views of the air-packing device which is folded to create a unique shape that wraps around a product to be protected.

FIG. 6A shows the process in which the air-packing device is folded and heat-sealed at the triangle portion and FIG. 6B shows the process in which the air-packing device is heat-sealed at both sides and the air is supplied for inflating the air-packing device.

FIG. 19A is a plan view when the air-packing device is in the sheet form, FIG. 19B is a plan view when the air-packing device is inflated, and FIG. 19C is a side view of the air-packing device when inflated.

FIG. 20A is a plan view when the air-packing device is in the sheet form, FIG. 20B is a plan view when the air-packing device is inflated, and FIG. 20C is a side view of the air-packing device when inflated.

DETAILED DESCRIPTION OF THE INVENTION

The air-packing device of the present invention will be described in more detail with reference to the accompanying drawings. It should be noted that although the present invention is described for the case of using an air for inflating the air-packing device for an illustration purpose, other fluids such as other types of gas or liquid can also be used. The air-packing device is typically used in a container box to pack a product during the distribution flow of the product.

The air-packing device of the present invention is especially useful for packing a product which is sensitive to shock or vibration such as a personal computer, DVD driver, etc, having high precision mechanical components such as a hard disc driver. Other example includes wine bottles, glassware, ceramic ware, music instruments, paintings, antiques, etc. The air-packing device reliably supports the product in the container box so that the product can flexibly move in a substantially floating state, thereby absorbing the shocks and impacts to the product when, for example, the container box is inadvertently dropped on the floor or collided with other objects.

The air-packing device of the present invention includes a plurality of air containers each having a plurality of series connected air cells each. The air container is air-tightly separated from other while the air cells in the same air container are connected by the air passage. Each air cell has a sausage like shape when inflated. More specifically, two or more air cells are series connected through air passages to form a set (air container) of series connected air cells. Each set of series connected air cells has a check valve, typically at an input area to supply the air to all of the series connected air cells while preventing a reverse flow of the compressed air in the air cell. Further, two or more such sets (air containers) having series connected air cells are aligned in parallel with one another so that the air cells are arranged in a matrix manner.

Figure 3A:
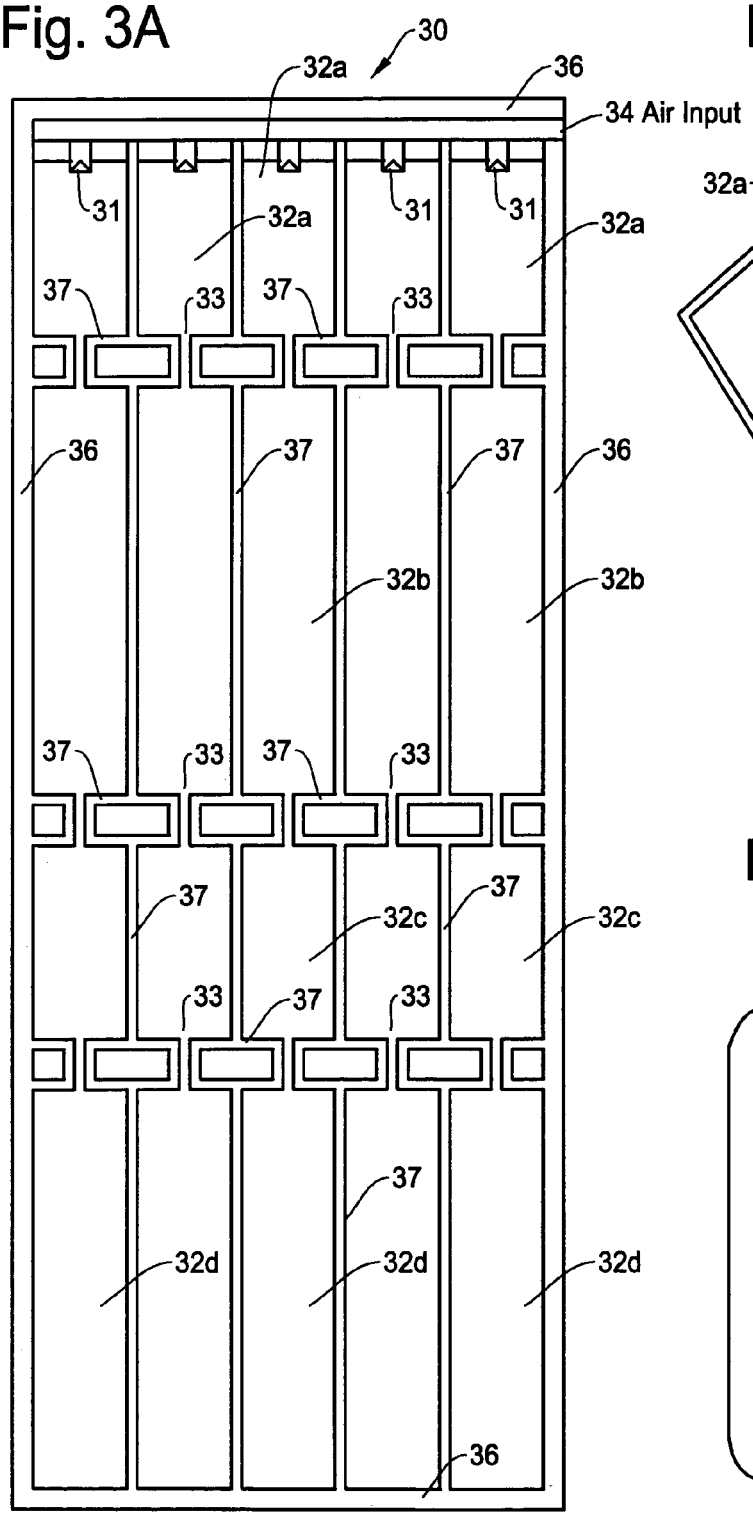
FIGS. 3A–3C show a basic concept of the air-packing device of the present invention where
Figure 3B:
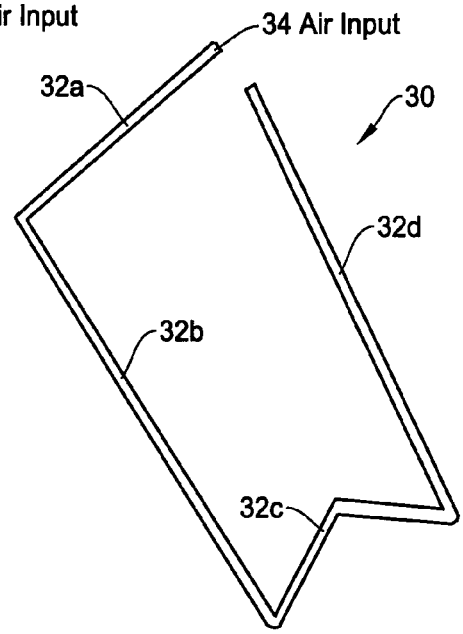
Figure 3C:
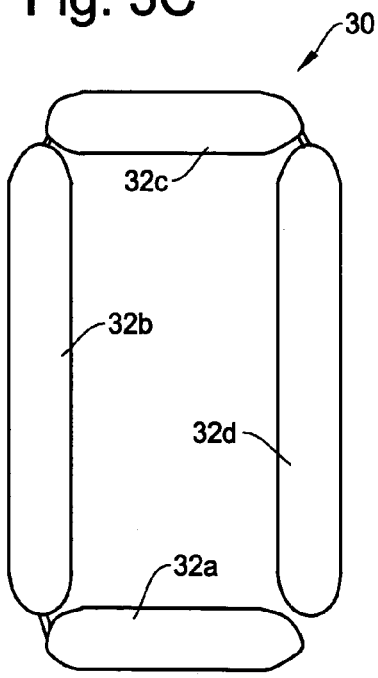

FIGS. 3A–3C show an example of the air-packing device of the present invention having plural sets of series connected air cells. FIG. 3A is a plan view showing a sheet like air-packing device before being folded or inflated by the air. FIG. 3B is a side view of the air-packing device which can be freely changed in shape by folding and heat sealing so as to wrap around a product. FIG. 3C is a cross sectional side view of the air-packing device which is inflated by the compressed air after the folding and heat sealing processes.

Figure 1:
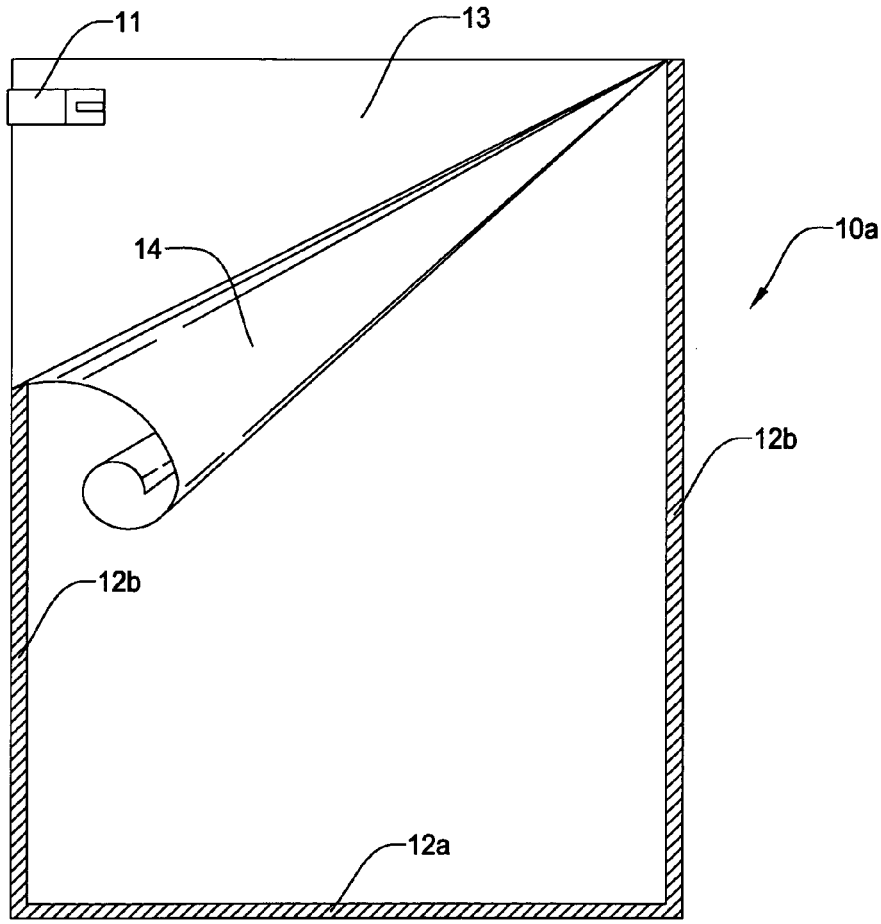
Fig. 1 (Prior Art)
FIG. 1 is a schematic diagram showing an example of basic structure of an air-packing device in the conventional technology.
Figure 2A:
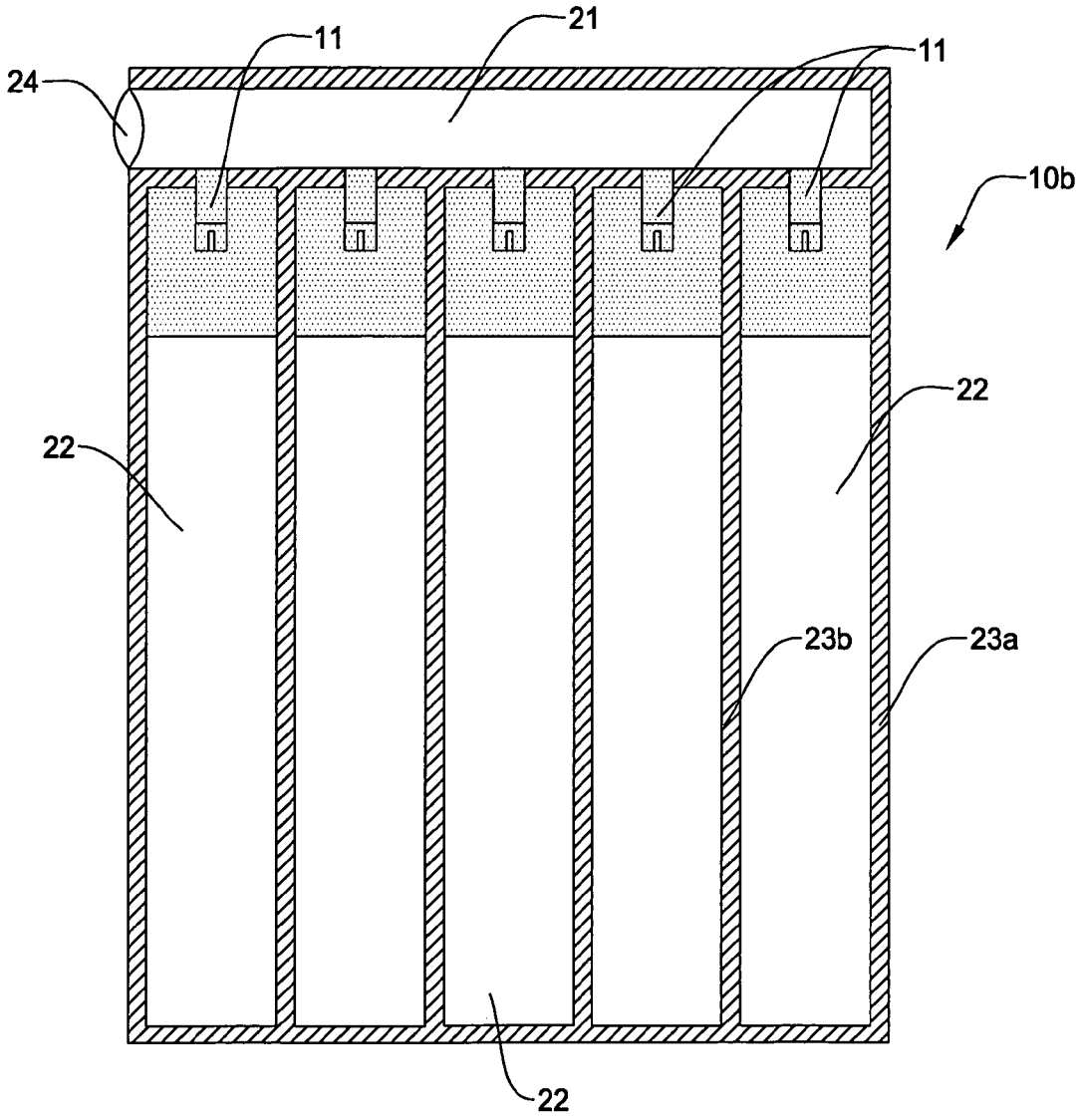
Fig. 2A (Prior Art)
FIGS. 2A and 2B are schematic diagrams showing an example of structure of an air-packing device having multiple air containers with use of check valves.
Figure 2B:
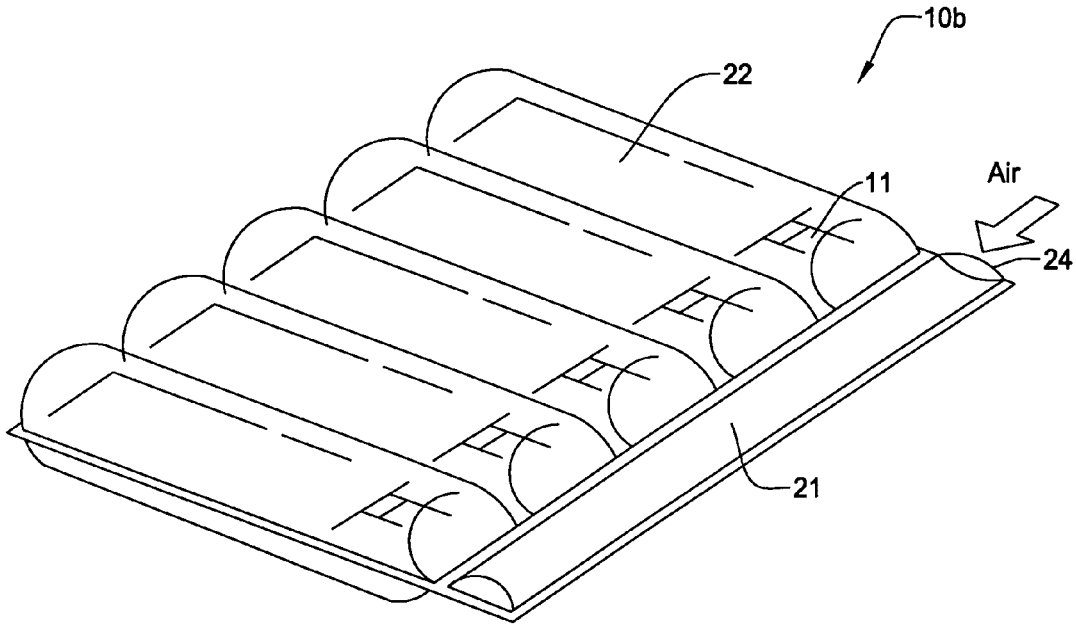
Fig. 2B (Prior Art)

As shown in FIG. 3A, the air-packing device 30 has multiple sets (air containers) each having series connected air cells arranged in parallel with one another. As described with reference to FIG. 1 and as will be described in more detail later, the air-packing device 30 is composed of first and second thermoplastic films and a check valve sheet. Typically, each of the thermoplastic films is composed of three layers of materials: polyethylene, nylon and polyethylene which are bonded together with appropriate adhesive. The first and second thermoplastic films are heat-sealed together at the outer edges 36 and a boundary 37 between the two sets of series connected air cells after the check valve sheet is provided therebetween.

Therefore, each set of series air cell is air-tightly separated from the other sets of series air cell where each set has multiple air cells 32*a*–32*d* which are series connected through air passages 33. At an input of each set of series connected air cells, a check valve 31 is provided to supply the air to the series of air cells 32*a*–32*d* through the air passages 33. The check valves 31 are commonly connected to an air input 34. Thus, when the compressed air is supplied to the air input 34, the air cells 32*a*–32*d* in each series set will be inflated. Because of the check valve 31 which prohibits the reverse flow of the air, the air cells remain inflated thereafter.

Before or after inflating the air, the air-packing device 30 of the present invention can be freely curved or folded to match the outer shape of the product to be protected. Thus, in the example shown in the side views of FIGS. 3B and 3C, the air-packing device 30 is so formed to wrap around the product (not shown). Typically, the product packed by the air-packing device 30 is further installed in a container box such as a corrugated carton. Thus, the air-packing device in the container box protects the product from the shock, vibration or other impact that may arise during the distribution process of the product.

Figure 4:
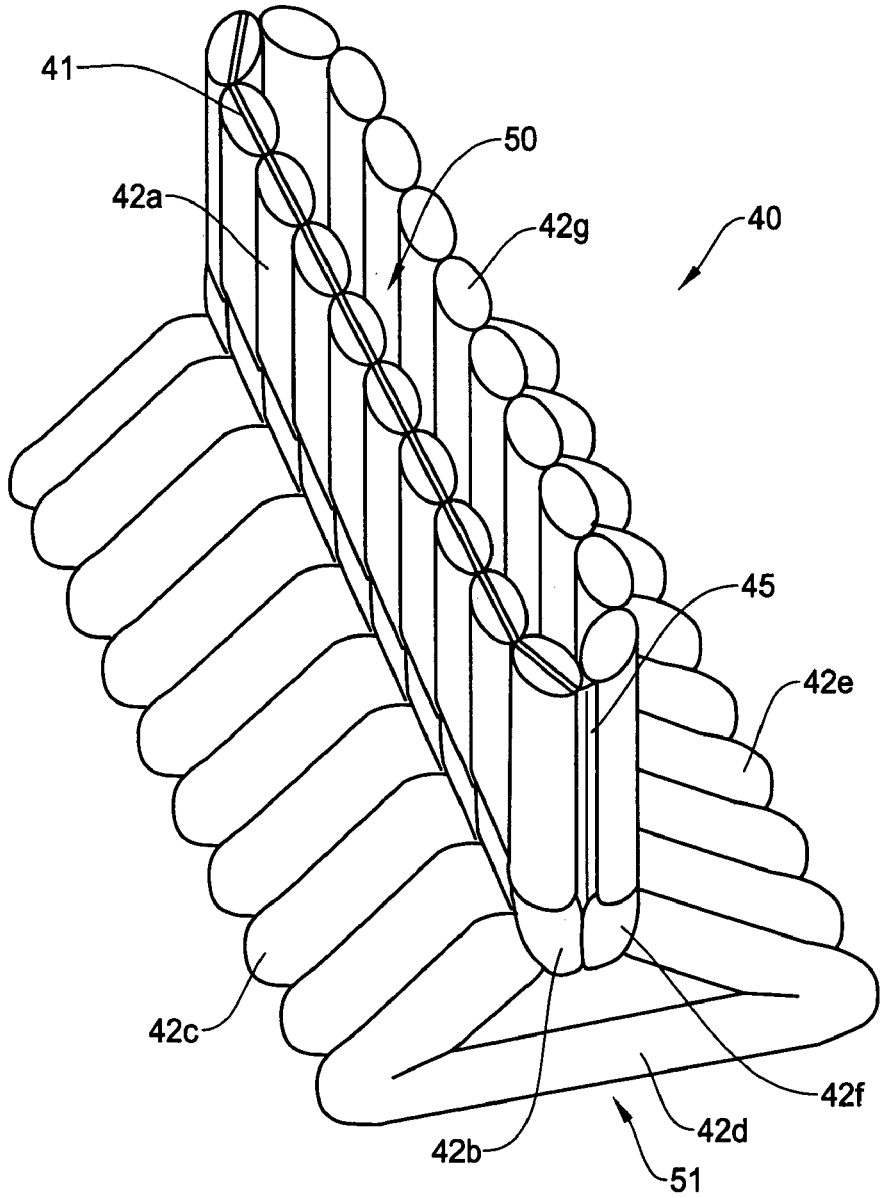
FIG. 4 is a perspective view showing an example of structure of the air-packing device in the first embodiment of the present invention formed of a cushion portion and a container portion for packing a product.

FIG. 4 is a perspective view showing a first embodiment of an air-packing device of the present invention for significantly reducing the shock and impact to the product. The air-packing device of the present invention is made of a plurality of air cells (air containers or air bags) as noted above. A sheet of air-packing device before forming the shape of FIG. 4 is shown in the plan view of FIG. 5. The shape of FIG. 4 is created by folding and heat-sealing (post heat-sealing treatment) the sheet of air-packing device of FIG. 5 before filling the air.

Figure 5:
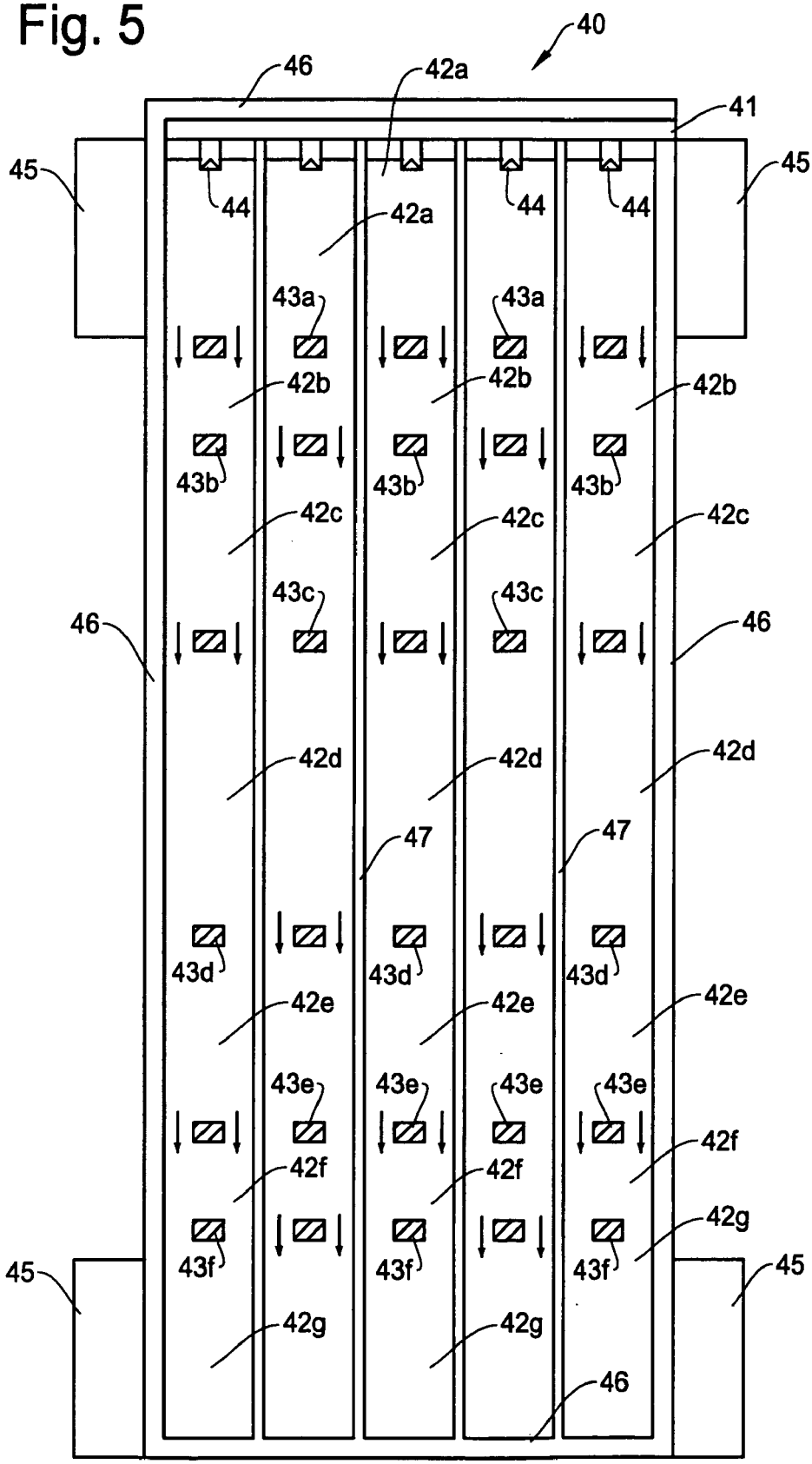
FIG. 5 is a plan view showing a sheet like structure of the air-packing device before folding and applying a post heat-sealing process for creating the shape of FIG. 4.

As shown in FIGS. 4 and 5, the air-packing device 40 has many sets of air cells each having a check valve 44 and series connected air cells 42*a*–42*g*. An air input 41 is commonly connected to all of the check valves 44 so that the air is supplied to each set of air cells 42–42*g* through the check valve 44. The air-packing device 40 also includes heat-seal flanges 45 for forming the opening (container portion) 50 of FIG. 4 by the post heat-sealing treatment.

Similar to the example of FIG. 3, and as will be described in more detail later, the air-packing device 40 is composed of first and second thermoplastic films and a check valve sheet. Typically, each of the thermoplastic films is composed of three layers of materials: polyethylene, nylon and polyethylene which are bonded together with appropriate adhesive. The first and second thermoplastic films are heat-sealed together at the outer edges 46 and each boundary 47 between two sets of series connected air cells after the check valve sheet is inserted therein.

The first and second thermoplastic films are also heat-sealed at locations (heat-seal lands) 43*a*–43*f* for folding the air-packing device. Thus, the heat-seal lands 43*a*–43*f* close the first and second thermoplastic films at the locations but still allow the air to pass toward the next air cells as shown by the arrows at both sides of each heat-seal land 43. Since the portions at the heat-seal lands 43 are closed, each air container 42 is shaped like a sausage when inflated. In other words, the air-packing device 40 can be easily bent or folded at the heat-seal lands to match the shape of the product to be protected.

Figure 6B:
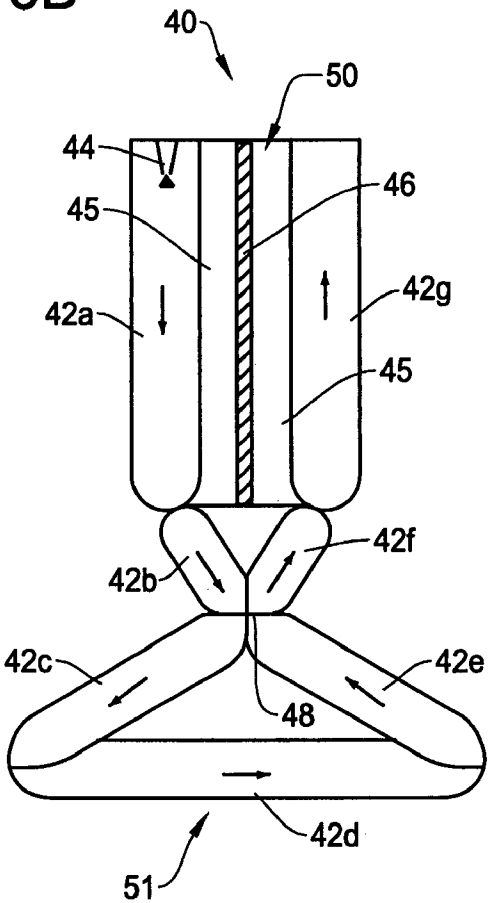
FIGS. 6A and 6B are side views showing a process of forming the air-packing device of FIG. 4 from the sheet like shape of FIG. 5, where
Figure 6A:
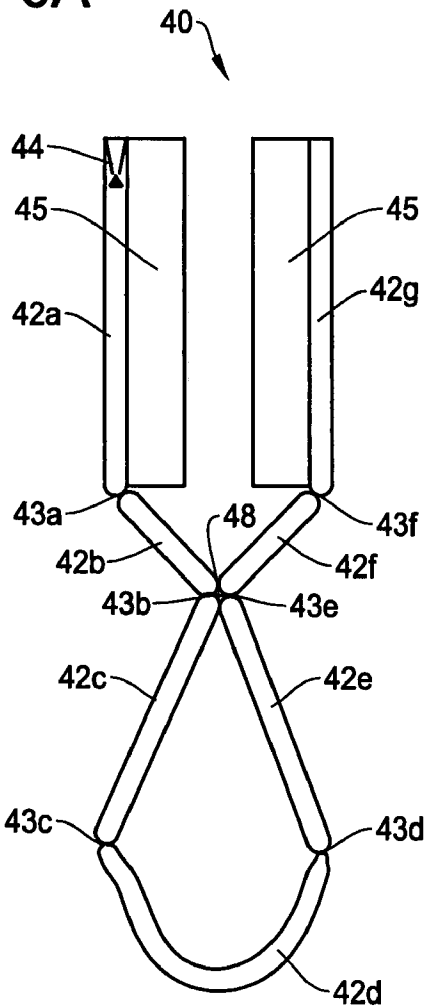

As shown in the side views of FIGS. 6A and 6B, by further applying a post heat-seal treatment to the sheet of FIG. 5, the air-packing device having a unique shape as shown in FIG. 4 is created. As shown in FIGS. 4 and 6B, the air-packing device 40 has a container (pouch) portion 50 having an opening for packing a product therein and a cushion portion 51 having a predetermined cushion shape to absorb the shock and vibration. The container portion 50 is formed at the summit of the cushion portion 51. In the example of FIGS. 4–6B, the cushion portion 51 has a shape of substantially triangle. However, other shapes such as a rectangular shape are also feasible as a cushion portion as will be explained later.

Figure 7:
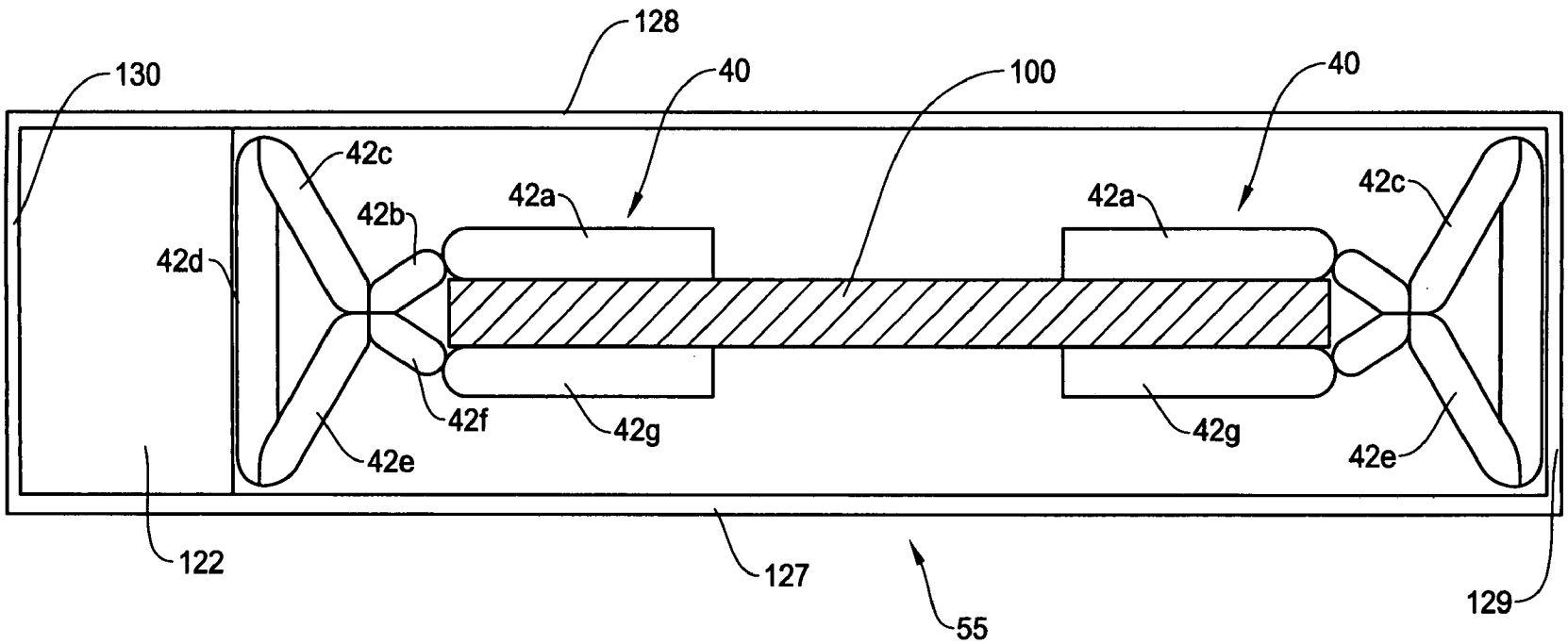
FIG. 7 is a cross sectional view showing an example of a container box in which a pair of air-packing devices of the present invention shown in FIGS. 4–5 and 6A–6B are incorporated for packing a product to prevent damages when dropped or collided.

The cushion portion 51 mainly serves to reduce the shock and impact to the product when the container box is dropped or collided against other objects, although the container portion 50 also serves to absorb the shock and impact to the product. The cushion portion 51 also serves to fit to inside walls of the container box into which the air-packing device holding the product is installed (FIG. 7). The example of FIGS. 4–6B has an outer appearance that the container portion 50 is formed on the top (heat seal point 48) of the triangle shaped cushion portion 51.

In the post heat-seal treatment, the air-packing device 40 is folded to a predetermined shape and heat-sealed at the heat-seal lands 43*b* and 43*e* (FIG. 6A) as well as the overlapped areas 46 of the heat-seal flanges 45 (FIG. 6B). It should be noted that the heat-seal between the heat-seal lands 43*b* and 43*e* in the post heat-seal process need not be exactly the same lands but can be anywhere close to the heat-seal lands 43*b* and 43*e*. After the post heat-seal treatment, the air is supplied to the air input 41 as shown FIG. 6B. The arrows in the sausage like air cells indicate the direction of air flow when the air is introduced to the air-packing device 40.

In FIG. 6B, the air introduced from the air input 41 flows into the air cells 42*a* at the left side, then to the air cells 42*b* which link the container portion 50 and the cushion portion 51, to the air cells 42*c* forming triangle arms of the cushion portion 51, then to the air cells 42*d* forming the cushion bottom members, and similarly to the air cells 42*e*, 42*f* and 42*g* at the right side. Thus, the air-packing device 40 creates the unique shape having the container portion 50 and the cushion portion 51 where the heat-seal lands 43*b* and 43*e* are bonded together at the heat-seal point 48. The opening of the container portion 50 is to receive the product to be protected therein. The heat-sealed points 48 work as link points to connect the container portion 50 and the cushion portion 51.

Any appropriate means may be used to supply the air or other fluid to the air-packing device of the present invention. For instance, an air compressor with a gauge may be used that sends the air to the air-packing device 40 while monitoring the pressure. The air input 41 functions to introduce the air to all the air cells through the corresponding check valves 44 so that the air-packing device as a whole inflates to form the predetermined shape. In the foregoing example, the air input 41 is located at the top of the air-packing device 40. However, the air input 41 may be located at other locations as long as it can function as a duct to provide the air to the air cells to inflate the air-packing device 40. When the air is supplied to the air-packing device, the air will reach all the air cells series connected to one another.

Once all of the air cells 42*a*–42*g* are inflated at a predetermined pressure, each check valve 44 provided to each set of air cells prevents the reverse flow of the air. Thus, even if one set of air cells is broken, other sets of air cells are not affected since each set of air cells has its own check valve and thus independent from the others. Because there are multiple sets of air cells, the shock absorbing function of the present invention can be maintained even when one or more air cells are broken.

FIG. 7 is a cross sectional view showing an example of container box and the air-packing device of the present invention for installing the product therein. In this example, two air-packing devices 40 are used to pack a product 100, such as a laptop computer or a DVD driver, at the both ends by the container portions 50. The container box 55 has side walls 127–130 to hold the air-packing devices 40 and the product 100 therein. In this example, a parts box 122 is formed at one end of the container box 55 to install various components unique to the product 100 such as a cable, disc, manuals, etc.

The cushion portion 51 contacts with the inner walls of the container box 55 while the container part 50 is in the air in a floating manner. Namely, the air cell 42*d* forming the base of the triangle shape contacts with the inner wall 129 of the container box 55. Thus, when packed in the container box 55, the product 100 is held by the air-packing devices 40 and is floated within the container box 55 without directly contacting with the container box 55. Because each air cell is filled with air to an optimum pressure, the air-packing devices 40 can support the product 100 as though the package 100 floats in the container box 55. The shapes and sizes of the container portion 50 and the cushion portion 51 are designed to match the size, shape and weight of the product 100 and the container box 55. The container box 55 can be of any type, such as a corrugated carton or a wood box commonly used in the industry.

Because the pair of air-packing devices 40 support the product 100 at both sides in a substantially floating condition, the product 100 can move in the air depending on the flexibility of the air-packing devices 40 when a shock or impact is applied to the container box 55. In other words, the air-packing devices 40 can absorb the shocks and vibrations when, for example, the container box 55 is dropped to the ground or hit by other objects. The shock absorbing performance of the present invention is especially pronounced when the container box is dropped vertically.

Figure 8:
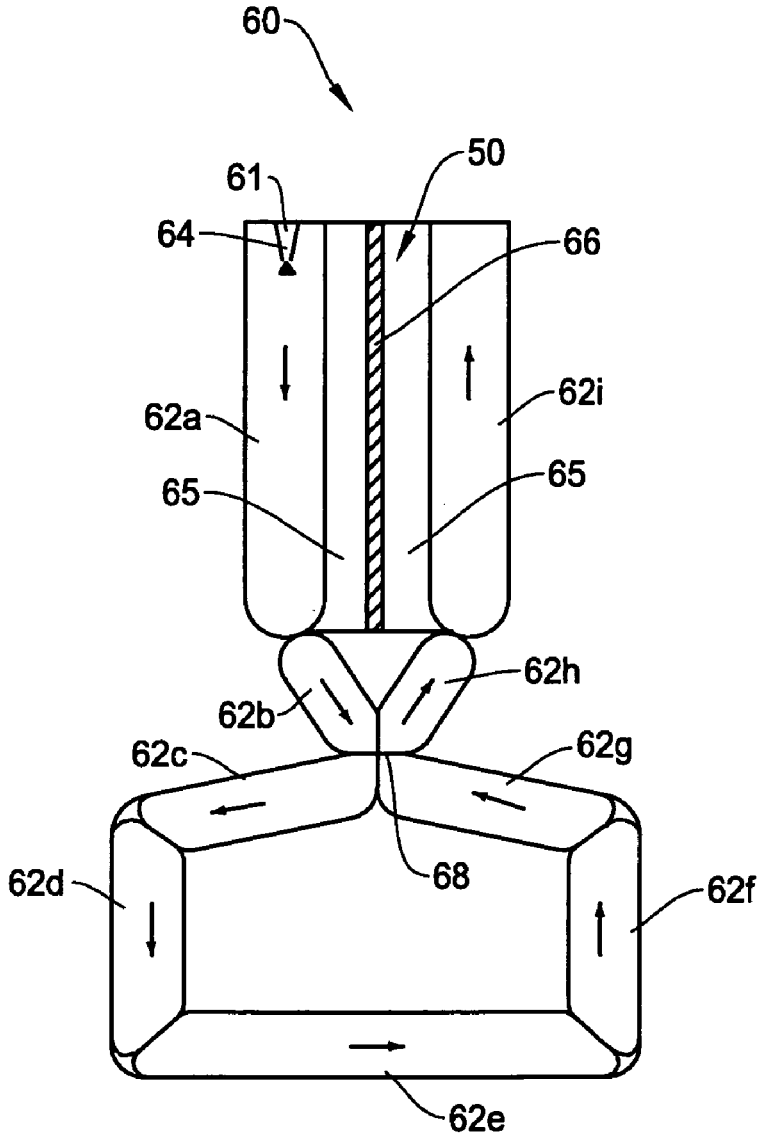
FIG. 8 is a side view showing another example of the air-packing device of the present invention where the cushion portion has a rectangular shape rather than the triangle shape of FIG. 6B and the flows of air introduced to inflate the air-packing device.
Figure 9:
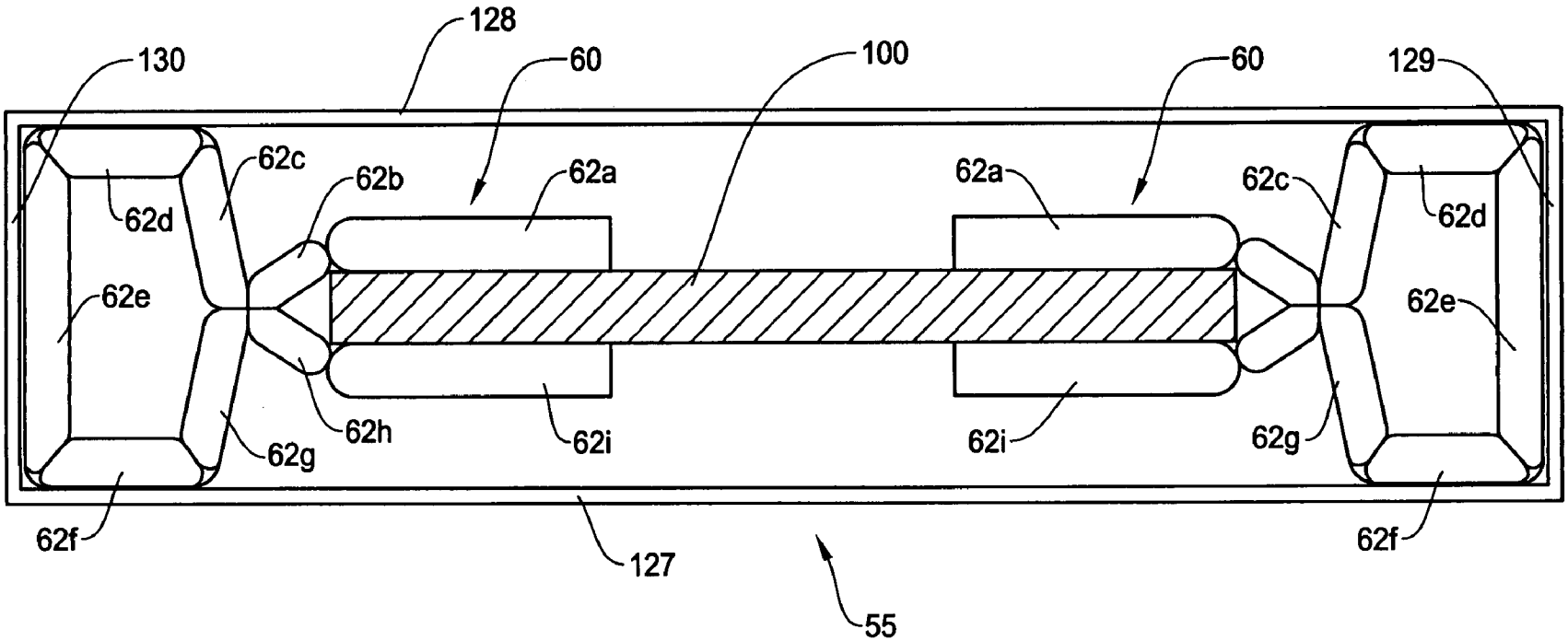
FIG. 9 is a cross sectional view showing another example of container box in which a pair of air-packing devices of the present invention shown in FIG. 8 are incorporated for packing a product to prevent damages when dropped or collided.

FIGS. 8 and 9 show another example of the air-packing device in the first embodiment of the present invention. FIG. 8 is a side view of the air-packing device of the present invention. FIG. 9 is a cross sectional side view showing an example of container box using two air-packing devices of the present invention. The structure of the air-packing device 60 in the example of FIGS. 8–9 is substantially the same as that shown in FIGS. 4–7 except that the shape of the cushion portion. In the example of FIGS. 8–9, the cushion portion 71 has a rectangular or pentagon shape rather than the triangular shape. Thus, the number of air cells is increased to form the sides of the pentagon cushion portion 71 (air cells 62*d* and 62*f*).

More specifically, the air-packing device 60 has many sets of air cells each having a check valve 64 and series connected air cells 62*a*–62*i*. An air input 61 is commonly connected to all of the check valves 64 so that the air is supplied to each set of air cells 62*a*–62*i* through the check valve 64. The air-packing device 60 also includes heat-seal flanges 65 for forming the container portion 50 by the post heat-sealing treatment.

As shown in the side view of FIG. 8, by further applying a post heat-seal treatment to the sheet of air packing device 60, the container (pouch) portion 50 having an opening for packing a product therein and the cushion portion 71 having a pentagon or rectangular shape to absorb the shock are respectively created. The container portion 50 is formed on the summit of the cushion portion 71. The cushion portion 71 mainly serves to reduce the shocks and impact to the product when the container box is dropped or collided against other objects, although the container portion 50 also serves to reduce the shock and impact to the product. The cushion portion 71 also serves to securely fit to the inside walls of the container box into which the air-packing devices holding the product are installed (FIG. 9) by the rectangular shape thereof.

After the post heat-seal treatment, the air is supplied to the air input 61 as shown FIG. 8. The arrows in the sausage like air cells indicate the direction of air flow when the air is introduced to the air-packing device 60. In FIG. 8, the air introduced from the air input 61 and the check valve 64 flows into the air cells 62*a* at the left side, then to the air cells 62*b* which link the container portion 50 and the cushion portion 71, to the air cells 62*c* forming inclined arms of the cushion portion 71, then to the air cells 62*d* forming the side of the cushion portion which contact the inner wall of the container box (FIG. 9), then to the air cells 62*e* forming the bottom member of the cushion portion which contacts with the inner wall, and similarly to the air cells 62*f*, 62*g*, 62*h* and 62*i* at the right side. Thus, the air-packing device 60 creates the unique shape having the container portion 50 and the cushion portion 71 connected at the heat-sealed point 68.

Once all of the air cells 62*a*–62*i* are inflated at a predetermined pressure, each check valve 64 provided to each set of air cells prevents the reverse flow of the air. Thus, even if one set of sausage like air cells is broken, other sets of air cells are not affected since each set of air cells has its own check valve and thus independent from the others. Because there are multiple sets of air cells, the shock absorbing function of the air-packing device of the present invention can be maintained.

FIG. 9 is a cross sectional view showing an example of container box using the air-packing device of the present invention. In this example, two air-packing devices 60 of FIG. 8 are used to pack a product 100, such as a laptop computer or a DVD driver, at both the ends of the product 100 by the container portions 50. The container box 55 has side walls 127–130 to hold the air-packing devices 60 and the product 100 therein.

The cushion portion 71 contacts with the side walls of the container box 55 by the air cells 62*d*, 62*e* and 62*f* while the container portion 50 is in the air in a floating manner. Thus, when packed in the container box 55, the product 100 is held by the air-packing devices 60 and is floated within the container box 55 without directly contacting with the container box 55. Because each air cell is filled with air to an optimum pressure, the air-packing devices 60 can support the product 100 as though the package 100 floats in the container box 55. The shapes and sizes of the container portion 50 and the cushion portion 71 are designed to match the size, shape and weight of the product 100 and the container box 55. The container box 55 can be of any type, such as a corrugated carton, a plastic box, or a wood box commonly used in the industry.

Because the pair of air-packing devices 60 support the product 100 at both sides in a substantially floating condition, the product 100 can move in the air depending on the flexibility of the air-packing devices 60 when a shock or impact is applied to the container box 55. In other words, the air-packing devices 60 can absorb the shocks and vibrations when, for example, the container box 55 is dropped to the ground or hit by other objects. The shock absorbing performance of the present invention is especially pronounced when the container box 55 is dropped vertically.

Figure 10:
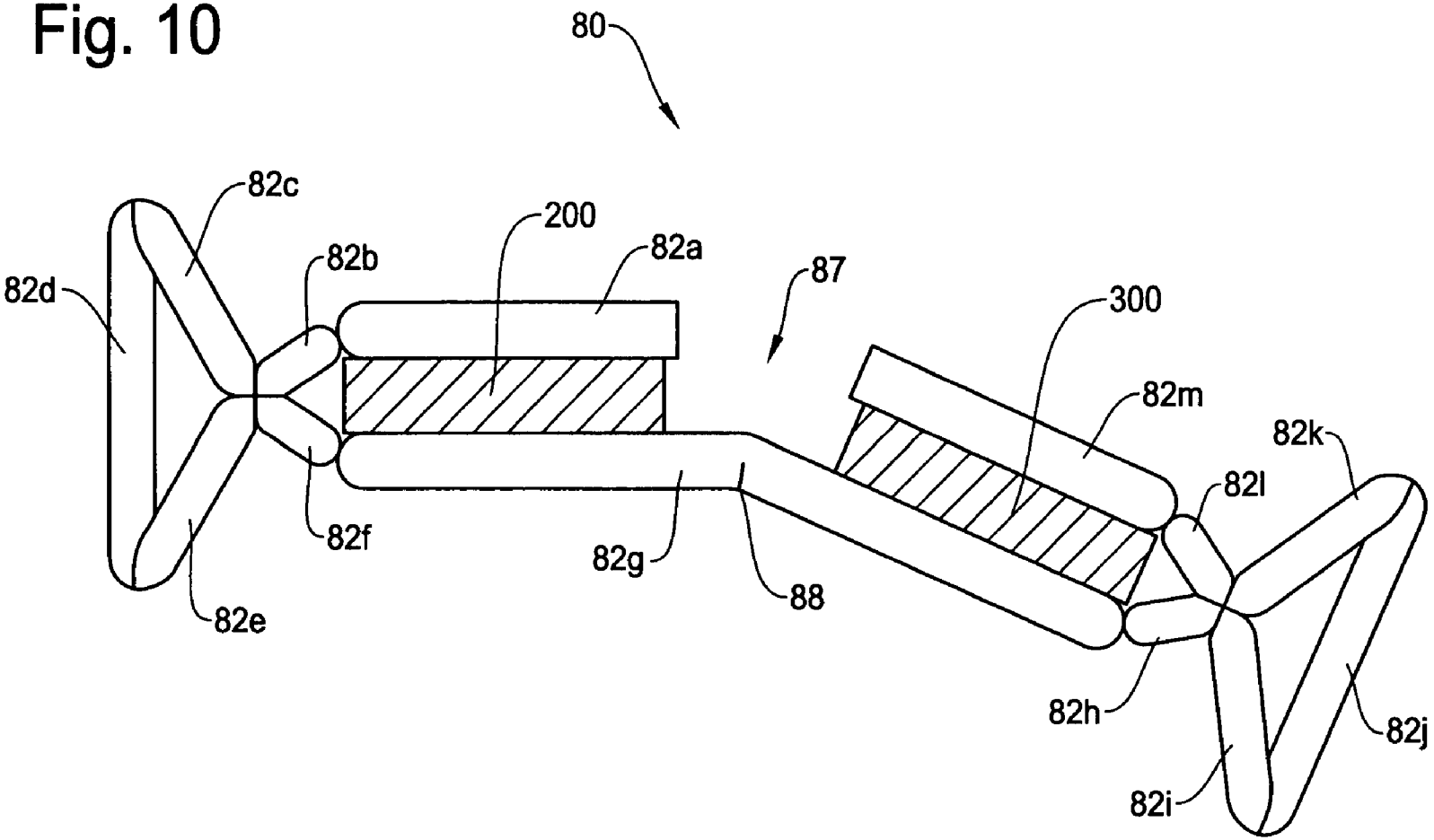
FIG. 10 is a side view showing another example of the air-packing device of the present invention where two air-packing devices of FIGS. 4–6B are integrally constructed to form one air-packing device where the cushion portion has a triangular shape.

FIG. 10 is a cross sectional side view showing a further example of air-packing device in the first embodiment of the present invention where two air-packing devices 40 such as shown in FIGS. 4–6B are integrally constructed to form one air-packing device having two container portions (pockets) and two cushion portions. The air-packing device 80 has a plural sets of series connected air cells 82*a*–82*m* defined by heat-seal lands 83*a*-83*l* as shown in more detail in FIG. 11A. Two separate products 200 and 300 can be installed in the container portions of the air-packing device 80 through an opening 87. Alternatively, one product such as a laptop computer or a DVD driver can be loaded in a manner similar to FIGS. 7 and 9.

When loading the products 200 and 300, the air-packing device 80 is bent at a bending point 88 either prior to supplying the compressed air or after filling the air so that the products 200 and 300 can be easily introduced through the opening 87. After the products 200 and 300 are securely placed in the container portions, the air-packing devices 80 are returned to a normal straight condition. Then, the air-packing device 80 and the products therein are placed in a container box in a manner similar to that described above with reference to FIGS. 7 and 9.

In the example of FIG. 10, because both ends of the air-packing device are integrally formed, two separate air-packing devices are not required, which makes it easy to stock the air-packing device, Further, since the air-packing device 80 is configured by one sheet, it increases the efficiency of inflating the air-packing device and loading the products in the container parts. Further, since the air-packing device 80 is configured by one sheet, only one check valve can be used for each set of series air cells, thereby reducing the material cost.

Figure 11A:
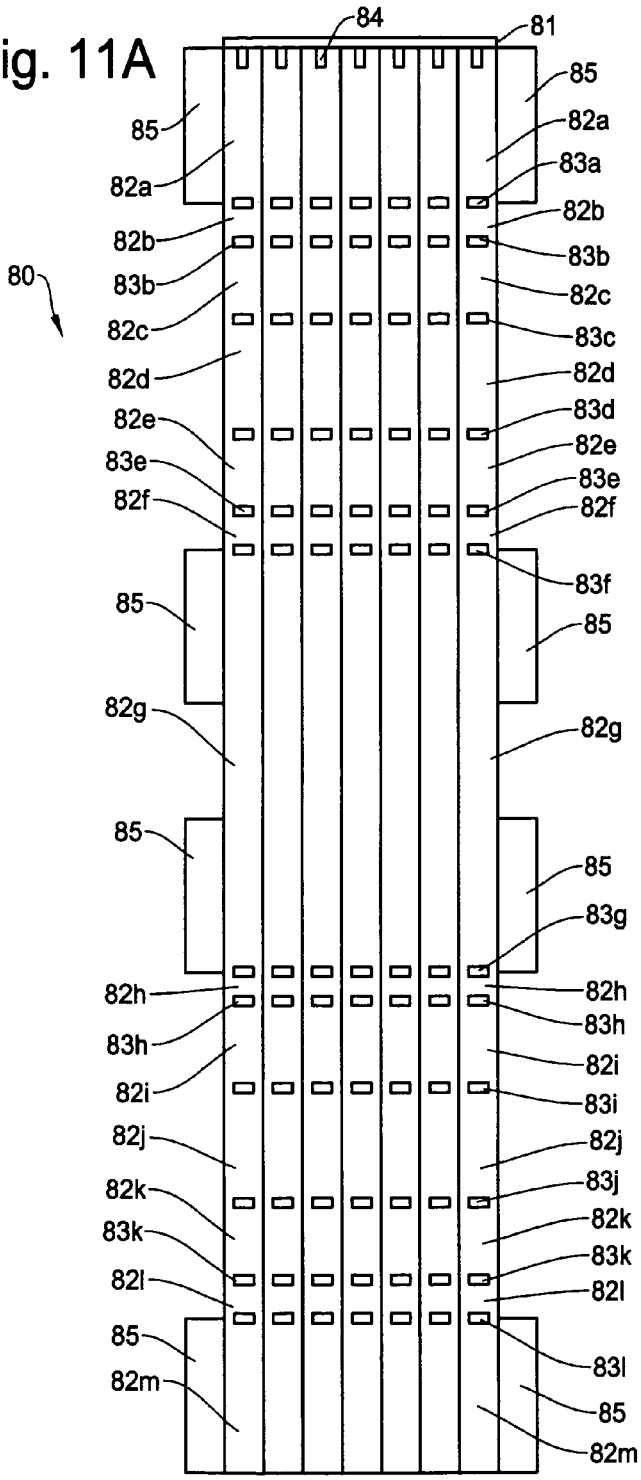
FIG. 11A is a plan view showing a sheet like structure of the air-packing device before folding and applying a post heat-sealing process for creating the shape of FIG. 10.
Figure 11B:
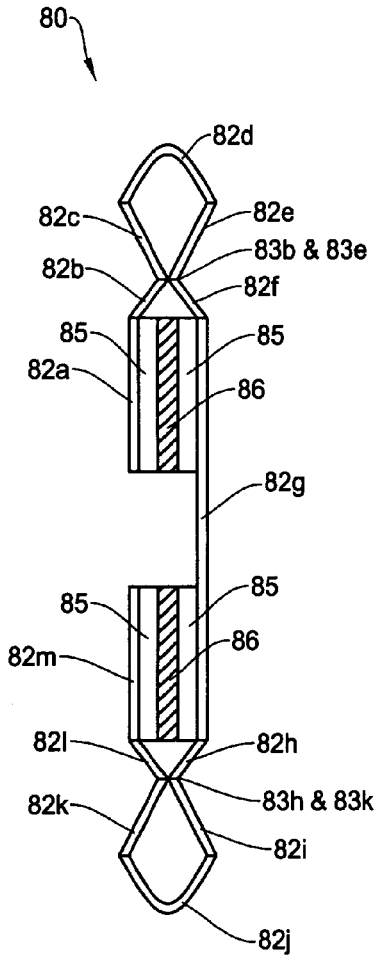
FIG. 11B is a side view showing the air-packing device which is bonded in the post heat-sealing process to establish the shape of FIG. 10.

FIG. 11A is a schematic plan view showing a sheet like structure of the air-packing device 80 of FIG. 10 before folding and applying a post heat-sealing treatment, and also, before supplying the compressed air. FIG. 11B is a side view showing the air-packing device 80 when it is folded and bonded through the post heat-sealing treatment to form the cushion portions and container portions shown in FIG. 11A. As shown in FIG. 11A, the air-packing device 80 has many sets of air cells each having a check valve 84 and series connected air cells 82*a*–82*m* which are defined by heat-seal lands 83*a*-831. An air input 81 is commonly connected to all of the check valves 84 so that the air is supplied to each set of series connected air cells 82*a*–82*m* through the corresponding check valve 84 and air passages at the sides of the heat-seal lands 83*a*-831. The air-packing device 80 also includes heat-seal flanges 85 on both sides of the air-packing device 80.

As shown in FIG. 11B, the sheet (thermoplastic films) of the air-packing device 80 of FIG. 11A is folded in a predetermined manner and the post heat-sealing treatment is applied to the sheet. Through the post heat-sealing treatment, the heat-seal lands 83*b* and 83*e* are bonded together, and the heat-seal lands 83*h* and 83*k* are bonded together to form the cushion parts. Also in the post heat-seal treatment, as shown by the hatched areas 86 in FIG. 11B, the pair of heat-seal flanges 85 are overlapped and bonded together to form the container portions.

The degree of overlapping of the heat-seal flanges 85 will be determined based on the intended size of the opening of the container portions for loading the product therein. After the post heat-seal treatment, the air-packing device 80 is inflated by the compressed air before or after loading the product therein. When inflated by the compressed air, each air cell 82 is shaped like a sausage, i.e, the air-packing device 80 can be easily folded at each heat-seal land to match the shape of the product to be protected as shown in FIG. 10.

Figure 12:
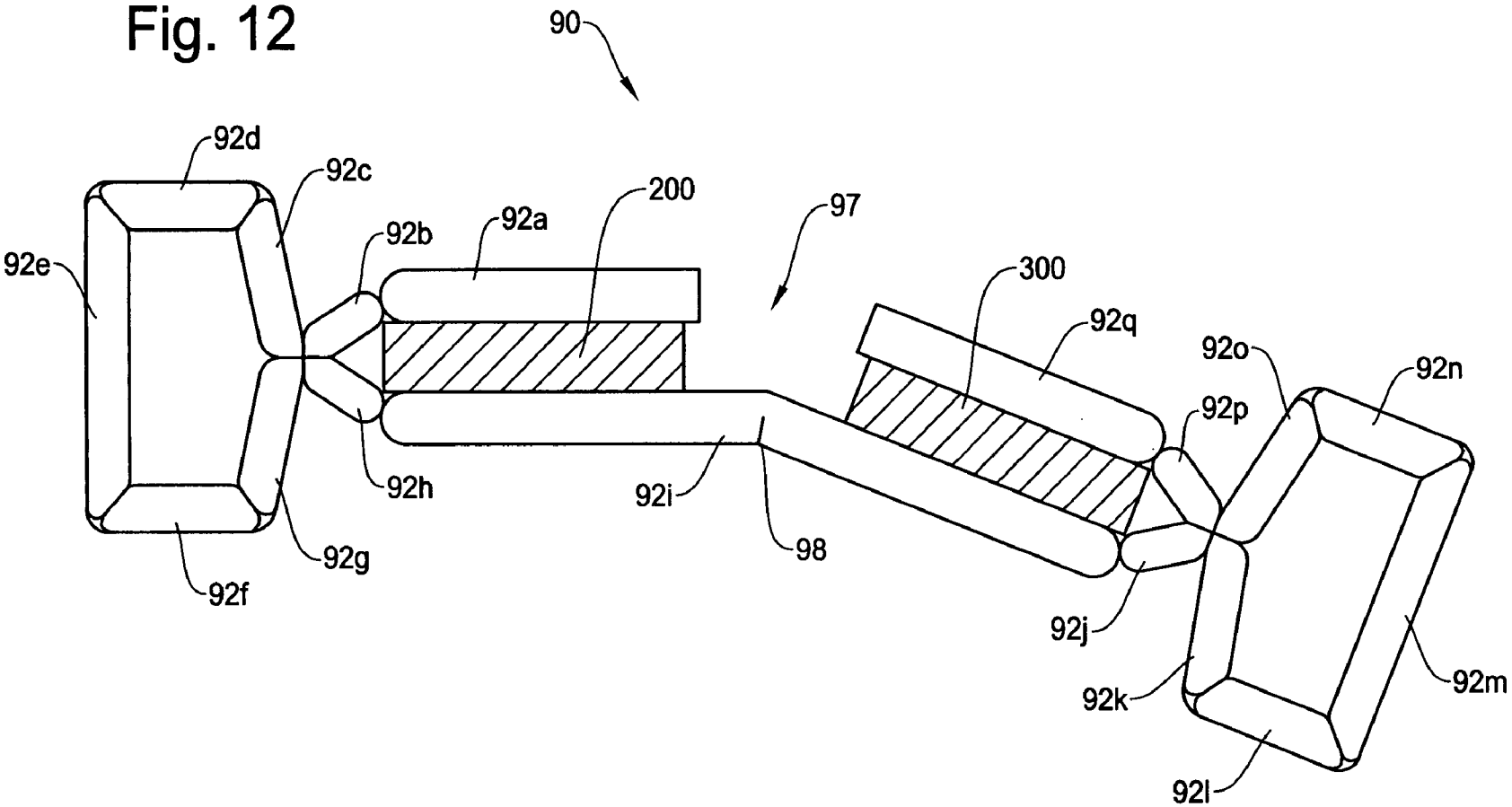
FIG. 12 is a side view showing another example of the air-packing device of the present invention where two air-packing devices of FIGS. 8 and 9 are integrally constructed to form one air-packing device where the cushion portion has a rectangular shape.

FIG. 12 is a side view showing another example of the air-packing device of the present invention where two air-packing devices of FIGS. 8 and 9 are integrally constructed to form one air-packing device where the cushion portion has a rectangular (pentagon) shape. The air-packing device 90 of FIG. 12 has a plural sets of series connected air cells 92*a*–92*q*. Similar to the example of FIG. 10, two separate products 200 and 300 can be installed in the container parts of the air-packing device 90 through an opening 97. Alternatively, one product such as a laptop computer can be loaded in a manner similar to FIGS. 7 and 9.

When loading the products 200 and 300, the air-packing device 90 is bent at a bending point 98 either prior to supplying the compressed air or after filling the air so that the products 200 and 300 can be easily introduced through the opening 97. After the products are securely placed in the container portions, the air-packing device 90 is returned to a normal straight condition. Then, the air-packing device 90 and the products therein are placed in a container box in a manner similar to that described above with reference to FIGS. 7 and 9.

In the example of FIG. 12, because both ends of the air-packing device 90 are integrally formed, two separate air-packing devices are not required, which makes it easy to stock the air-packing device, Further, since the air-packing device 90 is configured by one sheet, it increases the efficiency of inflating the air-packing device and loading the products in the container portions. Further, since the air-packing device 90 is configured by one sheet, only one check valve can be used for each set of series connected air cells, thereby reducing the material cost.

The second embodiment of the present invention is described with reference to FIGS. 13, 14A–14B, 15A–15C and 16. The air-packing device in the second embodiment has a further improved capability of absorbing the shock and vibration for protecting the product packed in the container box. An example of outer shape, when inflated by air, of the air-packing device in the second embodiment is illustrated in a perspective view of FIG. 13. The air-packing device 110 is formed of a double layer cushion portion 151 formed of zigzag arranged air cells and a container portion 150 having an opening for packing the product.

Figure 13:
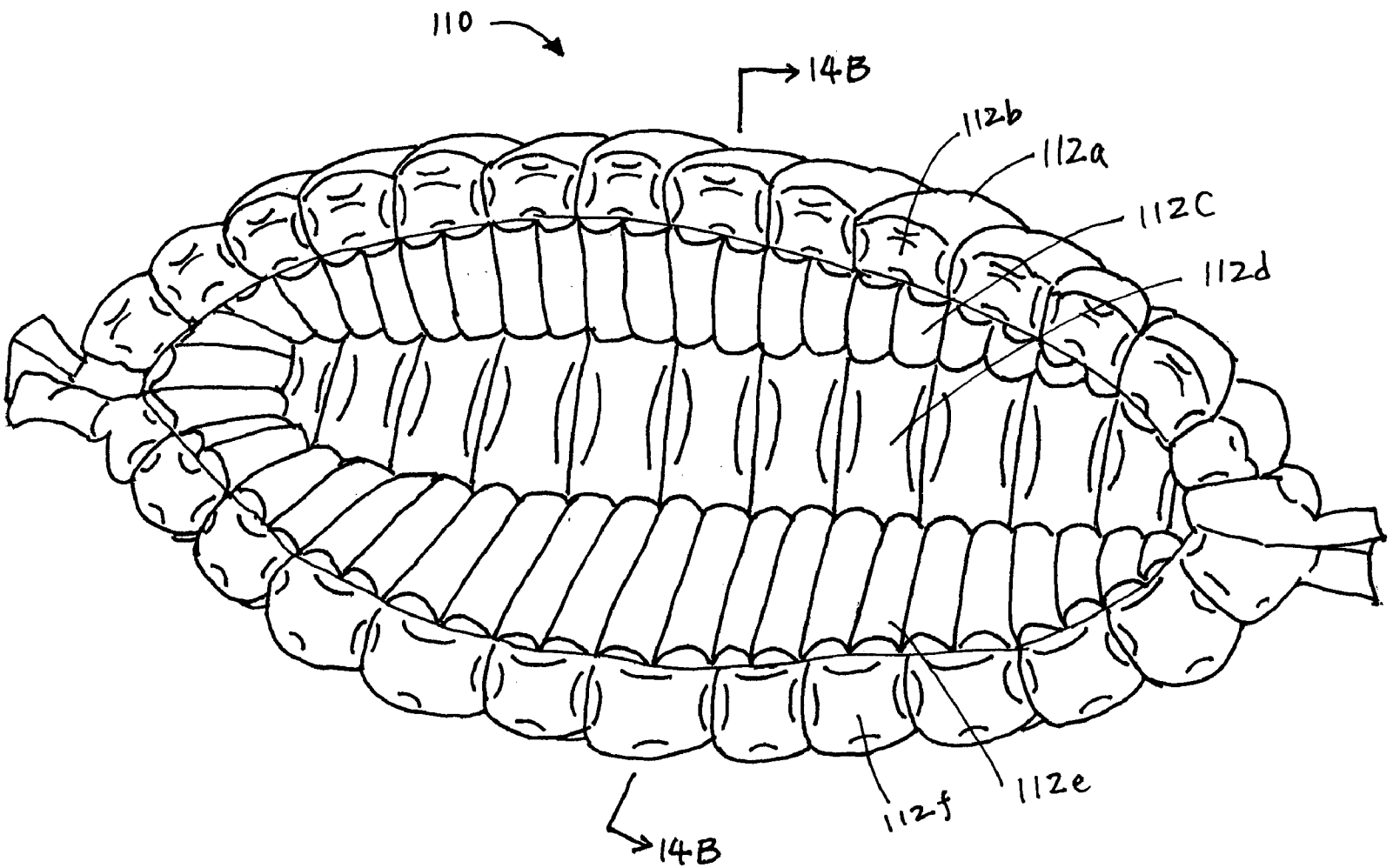
FIG. 13 is a perspective view showing an example of structure of the air-packing device in the second embodiment of the present invention formed of a double layer cushion portion and a container portion for packing a product for reducing the shock to the product.
Figure 14A:
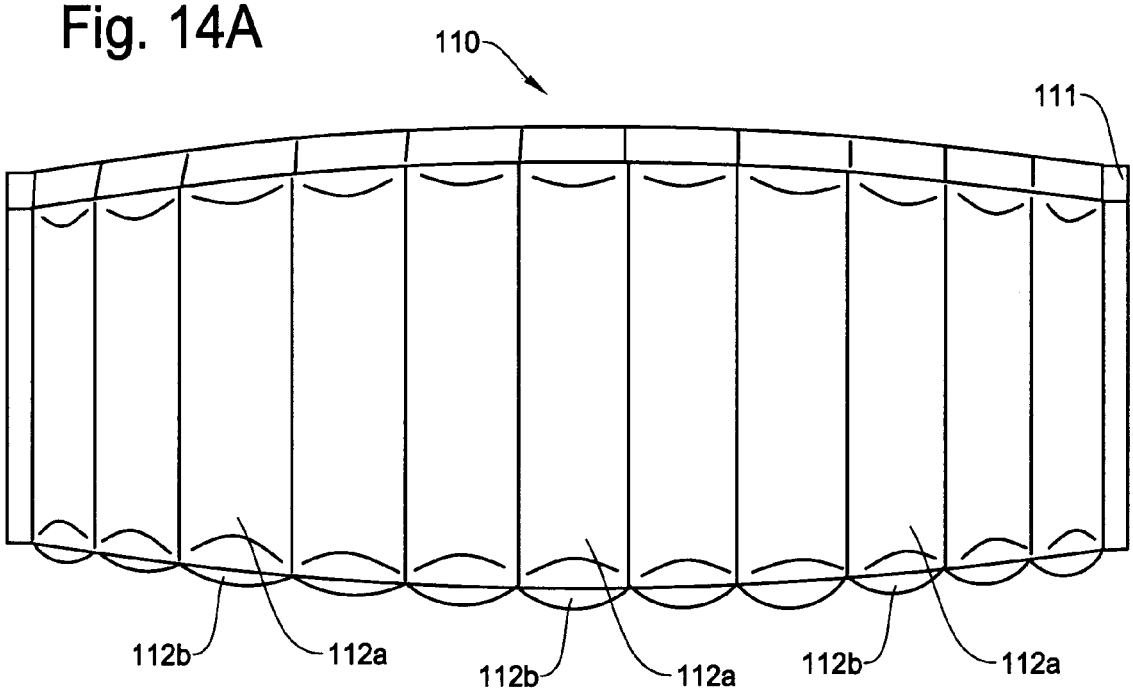
FIG. 14A is a plan view of the air-packing device of the present invention shown in FIG. 13.
Figure 14B:
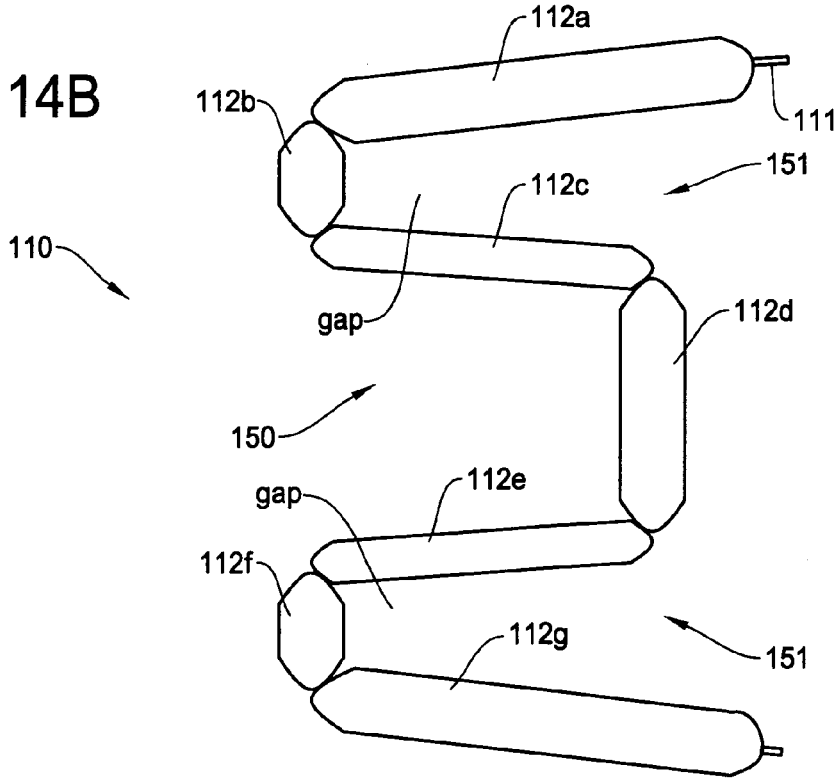
FIG. 14B is a cross sectional side view of the air-packing device of FIG. 13.

As shown in FIGS. 13 and 14A–14B, the air-packing device 110 has multiple sets of air cells where each set has a plurality of series connected air cells 112*a*–112*g* and a check valve 114. The air cells 112*a*–112*g* are defined by heat-seal lands 113*a*–113*f*. The plan view of FIG. 14A only shows the air cells 112*a* and 112*b* and check valves are not illustrated. As shown in the cross sectional view of FIG. 14B, the cushion portion 151 in the upper position of the air-packing device 110 is formed of the air cells 112*a*–112*c*, and the cushion portion 151 in the lower position thereof is formed of the air cells 112*e*–112*g*. In other words, each of the cushion portions 151 is configured by two layers of air cells. The container portion 150 having an opening is formed of the air cells 112*c*–112*e* for packing the product to be protected.

Preferably, as shown in the cross sectional view of FIG. 14B, the air cells 112*a* and 112*c* forming the double layer cushion are so designed that will not contact with one another when packing the product. Similarly, it is preferable that the air cells 112*a* and 112*c* forming the double layer cushion are so designed that will not contact with one another when packing the product. In other words, there is an air gap between the air cells 112*a* and 112*c* in the upper cushion part 151 and an air gap between the air cells 112*e* and 112*g*. This can be done by selecting the sizes (lengths) of the air cells 112*b* and 112*d* in such a way that, when inflated, the air cells 112*a*, 112*c*, 112*e* and 112*g* incline in a manner shown in FIG. 14B.

Preferably, the air cells 112*c* and 112*e* which also form the container portion 150 have a cross sectional size smaller than that of the other air cells. For example, two air-cells 112*c* are constructed for the width of one other air cell 112*b* or 112*d*. Similarly, two air-cells 112*e* are constructed for the width of one other air cell 112*d* or 112*f*. One of the advantages of this construction is that it is able to hold the product tightly therein.

Figure 15A:
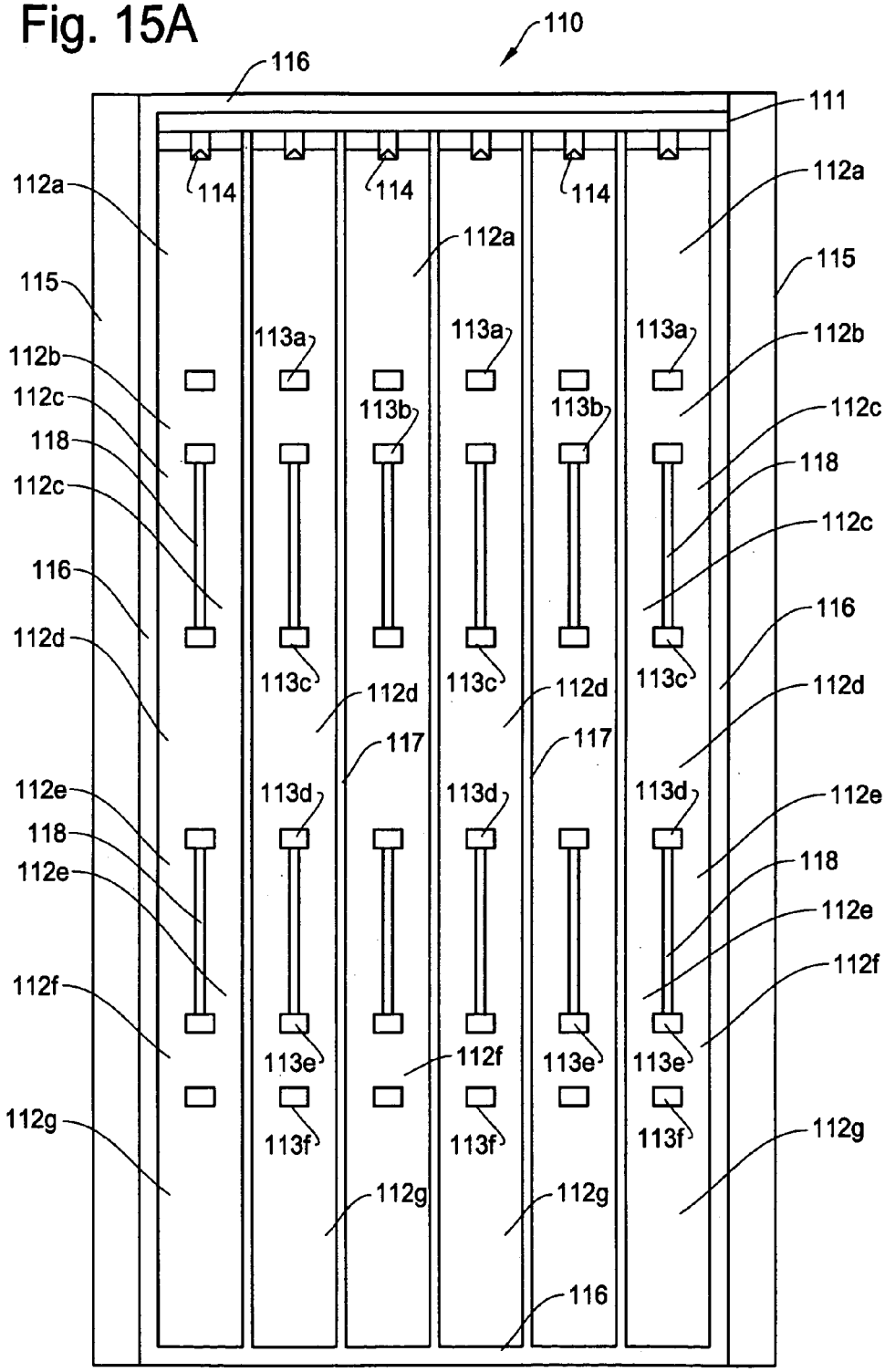
FIG. 15A is a plan view of the air-packing device in the second embodiment shown in FIG. 13 before being folded and inflated.

Before being folded and inflated, the air-packing device 110 is in a sheet like form as shown in FIG. 15A. As in the foregoing examples, the sheet of the air-packing device 110 is composed of first and second thermoplastic films and a check valve sheet. Typically, each of the thermoplastic films is composed of three layers of materials: polyethylene, nylon and polyethylene which are bonded together with appropriate adhesive.

The first and second thermoplastic films are heat-sealed together at the outer edges 116 and each boundary 117 between any two sets of series connected air cells 112*a*–112*g* after the check valve sheet is inserted between the first and second thermoplastic films. The first and second thermoplastic films are also heat-sealed at locations (heat-seal lands) 113*a*–113*f* for folding the air-packing device 110. Thus, the heat-seal lands 113*a*–113*f* close the first and second thermoplastic films at the locations but still allow the air to pass toward the next air cells at both sides of heat-seal lands 113.

In this example, each boundary 118 between the two air cells 112*c* and each boundary 118 between the two air cells 112*e* is also heat sealed. In other words, the heat seal is continuous throughout the heat-seal land 113*b*, boundary 118 and heat-seal land 113*c*, and also throughout the heat-seal land 113*d*, boundary 118 and heat-seal land 113*e*. As a result, the width of the air cells 112*c* and 112*e* becomes smaller than that of the other air cells, in this example, a half of the width of the other air cells.

At the sides of the air-packing device 110, heat-seal flanges 115 are provided for the post heat-seal treatment that is conducted after folding the sheet of the air-packing device 110. Each of the heat-seal flanges 115 has a sufficient width to create the open space of the container part 150 when the air packing device 110 is closed by the post-seal treatment. Since the portions at the heat-seal lands 113 and the boundaries 118 are closed, each air cell 112 has a sausage like shape when inflated as shown in FIGS. 13 and 14A–14B. Further, the air-packing device 110 can be easily folded at each location of the heat-seal land to match the shape of the product to be protected.

Figure 15B:
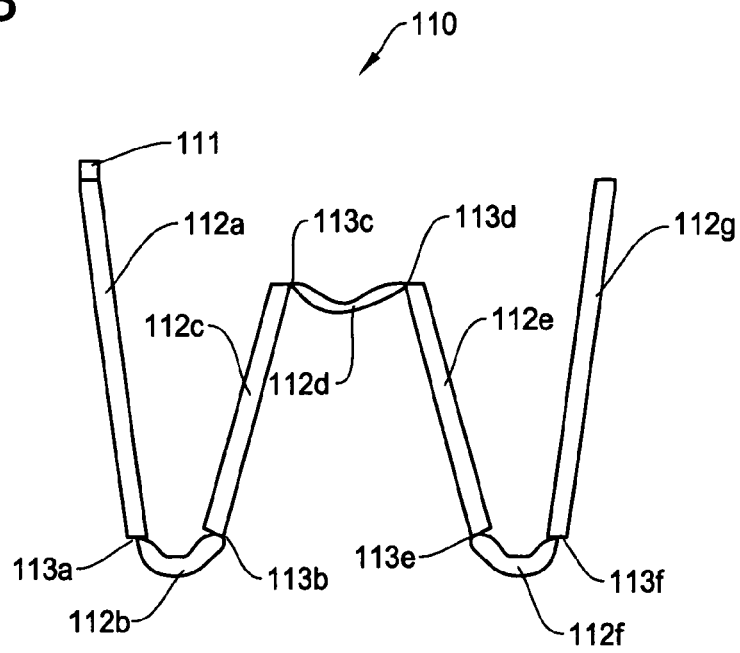
FIG. 15B is a side of the air-packing device of FIG. 13 showing a manner of folding before post heat-seal treatment.
Figure 15C:
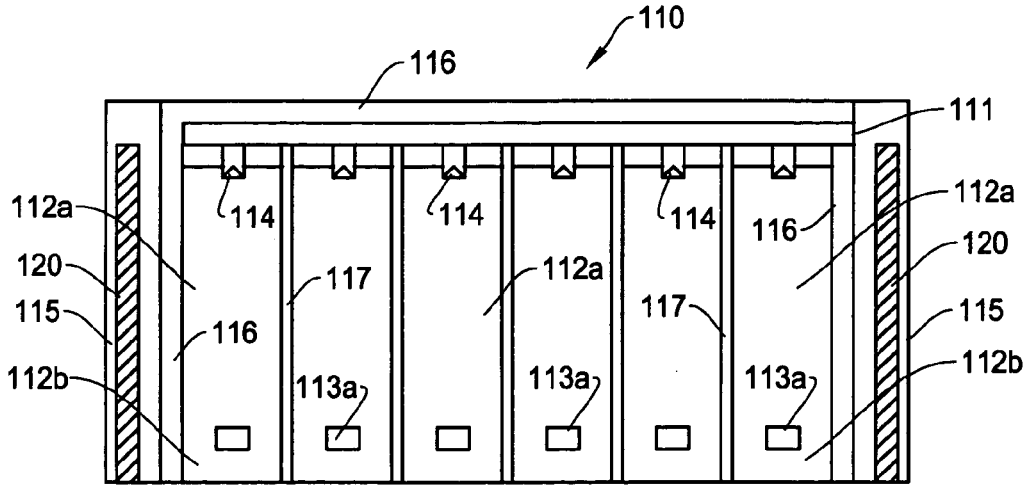
FIG. 15C is a plan view of the air-packing device of FIG. 13 after being folded and the post heat-sealing is applied thereto.

As shown in the side view of FIG. 15B, the sheet of air-packing device 110 shown in FIG. 15A is folded in a W-shape. Then, as shown in the top view of FIG. 15C, the sides of the air-packing device 110 are heat-sealed through the post heat-sealing treatment by overlapping the heat-seal flanges 115. In FIG. 15C, the overlapped areas (shaded areas 120) of the heat-sealing flanges 115 which are bonded together through the post heat-seal process. Thus, when supplying the compressed air, the air-packing device 110 having a unique shape as shown in FIG. 13 is created.

Figure 16:
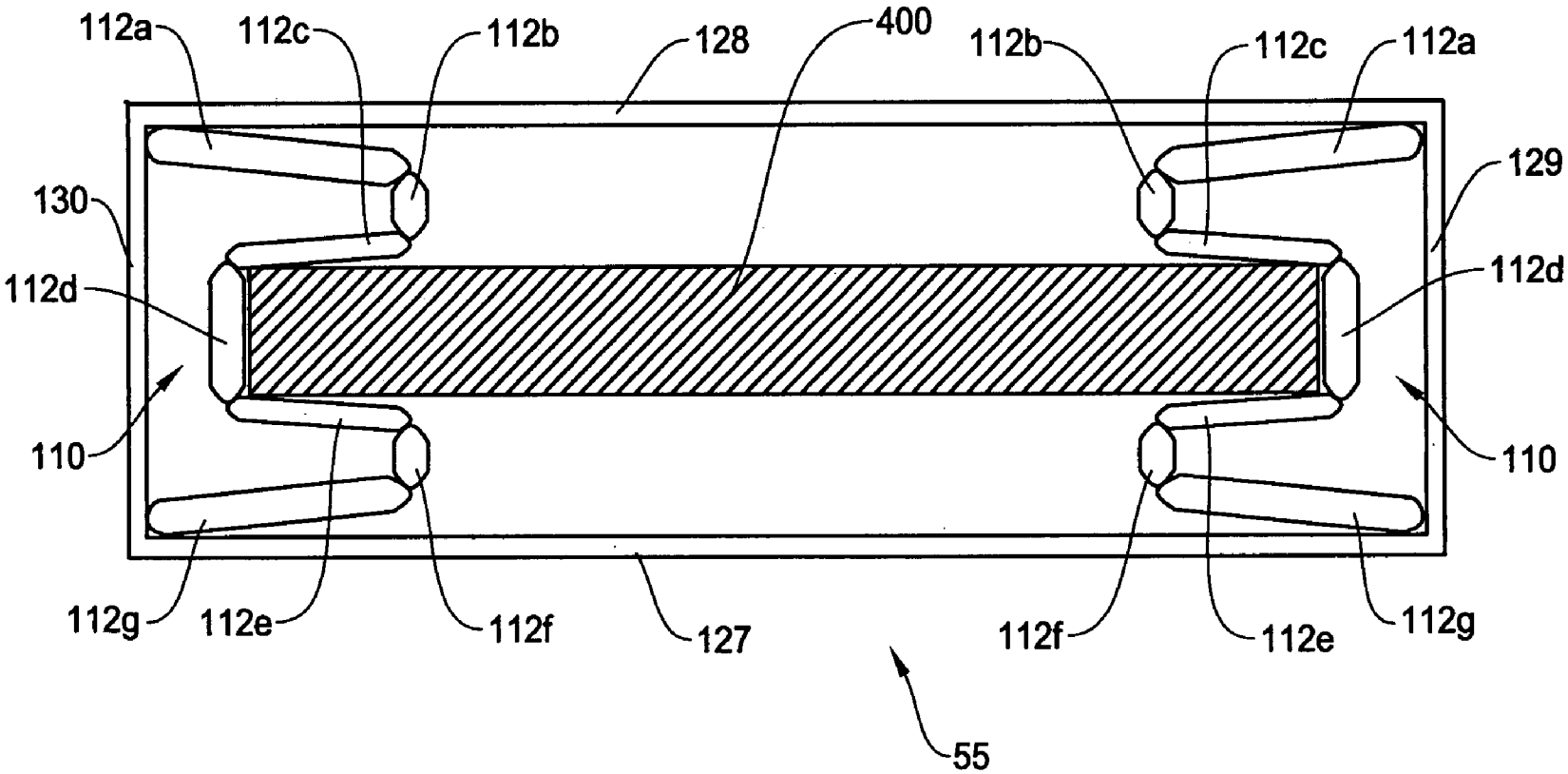
FIG. 16 is a cross sectional view showing an example of container box in which a pair of air-packing devices in the second embodiment of the present invention shown in FIGS. 13–15C are incorporated for packing a product.

FIG. 16 is a cross sectional view showing an example of container box 55 in which the air-packing devices 110 in the second embodiment of the present invention are incorporated. In this example, two air-packing devices 110 are used to pack a product 400, such as a laptop computer or a DVD driver, at both ends of the product 400 by the container portions 150. The container box 55 has side walls 127–130 to hold the air-packing devices 110 and the product 400 therein.

The cushion portions 151 contact with the side walls of the container box 55 while the container portions 150 are in the air in a floating manner. Thus, when packed in the container box 55, the product 400 is held by the air-packing devices 110 and is floated within the container box 55 without directly contacting with the container box 55. Because each air cell is filled with air to an optimum pressure, the air-packing devices 110 can support the product 400 as though the product 400 floats in the container box 55. The shapes and sizes of the container portion-150 and the cushion portion 151 are designed to match the size, shape and weight of the product 400 and the container box 55. The container box 55 can be of any type, such as a corrugated carton or a wood box commonly used in the industry.

Because the pair of air-packing devices 110 support the product 400 at both sides in a substantially floating condition, the product 400 can move in the air depending on the flexibility of the air cells 112 when a shock or impact is applied to the container box. In other words, the air-packing devices 110 can absorb the shocks and vibrations when, for example, the box is dropped to the ground or hit by other objects. Especially, because each cushion part 151 of the air-packing device 110 has the structure of double layer air cells such as 112*a* and 112 (or 112*e* and 112*g*), the shock received by the container box 55 is dramatically reduced before reaching the product 400. According to the experiment, the shock absorbing performance of the present invention is especially pronounced when there is the air gap between each of the double layer air cells as described with reference to FIG. 14B.

Figure 17:
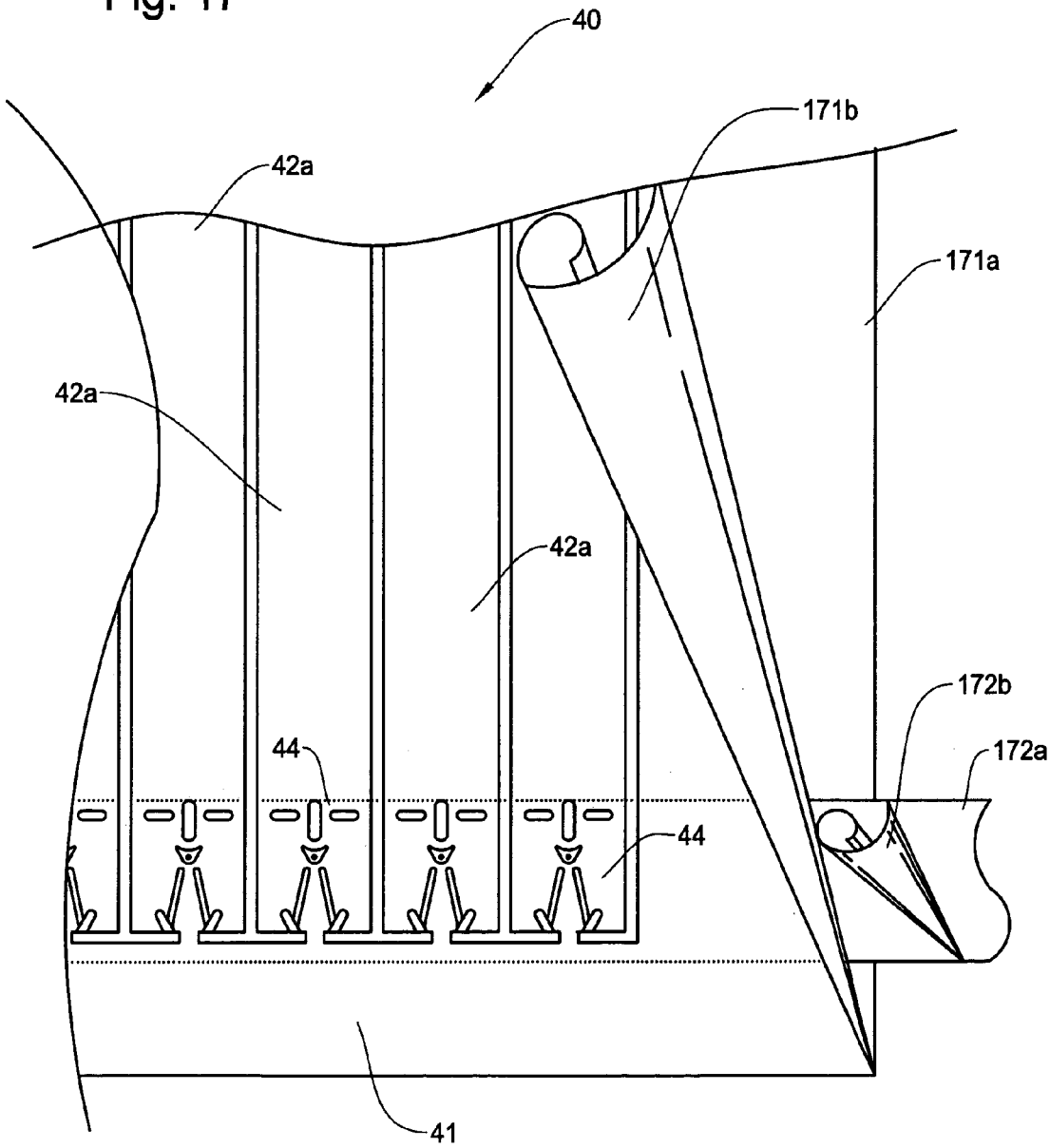
FIG. 17 is a plan view showing a detailed structure of the air-packing device of the present invention in the area of the check valve which is designed to easily be produced by an apparatus of FIG. 18.
Figure 18:
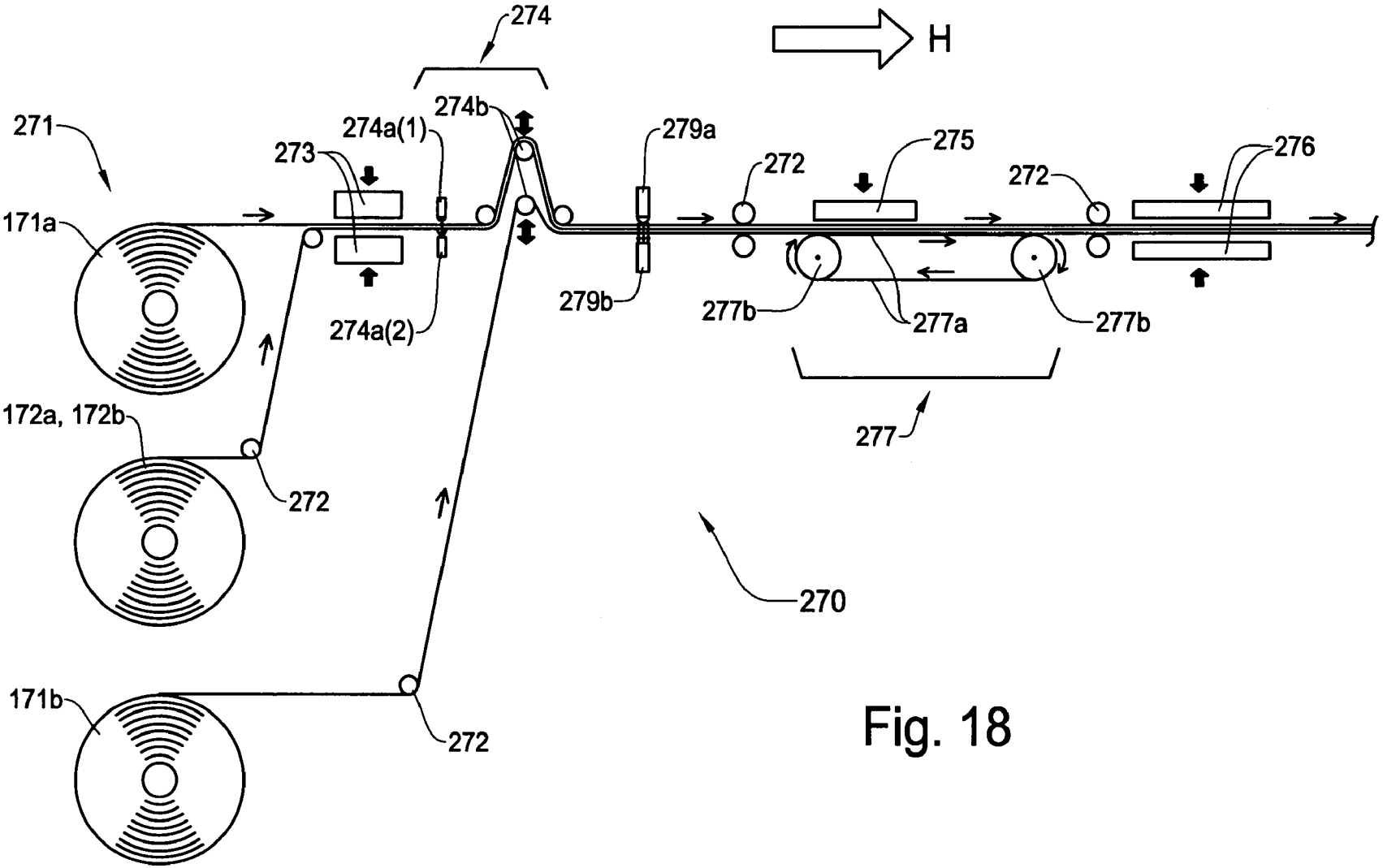
FIG. 18 is a schematic diagram showing an example of apparatus and process for continuously producing the air-packing devices of the present invention.

FIG. 17 is a plan view showing an example of detailed structure of the air-packing device of the present invention in the area of the check valve which is produced by a production apparatus of FIG. 18. The following explanation is made for the case of producing the air-packing device 40 shown in FIG. 5. Basically, the air-packing device 40 is made of three thermoplastic films; first and second air-packing films 171*a*–171*b* and a check valve film 172. The check valve film 172 in this example is configured by two films 172*a* and 172*b* although a single film is also possible to form a check valve. These films are bonded together by the heat-seal process to produce a sheet of air-packing device 40 such as shown in FIG. 5.

These films are supplied respectively by rolled film stocks 171*a*, 171*b*, 172*a* and 172*b* (FIG. 18). The four films are juxtaposed (laminated) in the order of the first air-packing film 171*a*, first valve film 172*a*, second valve film 172*b* and second air-packing film 171*b* as shown in FIG. 17. Then, through two or more steps of the heat-sealing process, the four films 171*a*, 171*b*, 172*a* and 172*b* are bonded together to make a plurality of air cells 42*a*–42*g*, an air input 41, and check valves 44 to create the sheet of air-packing device 40 shown in FIG. 5. The detailed structure and operation of the check valve 44 in FIG. 17 is described in U.S. patent application Ser. No. 10/610,501 filed Jun. 28, 2003.

FIG. 18 is a schematic diagram showing an example of apparatus for continuously producing the air-packing devices of the present invention. The detailed operation process of the manufacturing apparatus of FIG. 18 is described in U.S. patent application Ser. No. 10/610,501. A manufacturing apparatus 270 is comprised of a film feeding means 271, film conveying rollers 272, a valve heat seal device 273, an up-down roller controller 274, a sensor 279 for feeding the elongated plastic films, a right/left heat-seal (bonding) device 275, a belt conveyer 277 for the right/left heat-seal operation, and an upper/lower heat seal (bonding) device 276 for the up-down heat-seal operation.

The up-down roller controller 274 is provided to the manufacturing apparatus 270 in order to improve a positioning performance of the check valves. The up-down controller 274 moves rollers 274*b* in perpendicular (upward or downward) to a production flow direction H in order to precisely adjust the position of the check valve. Also, the belt conveyer 277 is provided to the manufacturing apparatus 270 in order to improve a heat seal performance.

In the overall manufacturing process shown in FIG. 18, first, the film feeding means 271 supplies elongated check valve films 172*a* and 172*b* which are juxtaposed (superposed) with each other, and the air-packing films 171*a* and 171*b* to the following stages of the manufacturing process. The film conveying rollers 272 at various positions in the manufacturing apparatus 270 guide and send the films forward in the production direction H. Every time each elongated film is advanced by a length equal to one air-packing device in the manufacturing flow direction, the heat seal processes are performed at a plurality of stages, such as three stages, in the production process.

The first stage of heat-sealing process is conducted by the valve heat-seal device 273. This is the process for forming the structure of the check valves 44 and bonding the check valve films 172*a*–172*b* to the first and second air-packing films 171*a*–171*b*. The position of the check valves 44 is precisely adjusted by the up-down roller controller 274 having optical sensors 274*a*.

The second stage of the heat-sealing process is done by using the right-left heat-seal device 275 and the belt conveyer 277 for sealing the outer edges 46 of the air-packing device 40 and boundaries 47 between the sets of series air cells. The belt conveyer 277 is used to prevent the heat-sealed portions by the right-left heat-seal device 275 from extending or broken. The belt conveyer 277 has two wheels 277*b* and a belt 277*a* on which a high heat resistance film such as a Mylar film is mounted. In the heat-seal process, the heat from the heat-seal device 275 is applied to the first and second air-packing films 171*a*–171*b* through the Mylar film on the conveyer belt 277*a*. The Mylar film may temporarily stick to the air-packing films 171*a*–171*b* immediately after the heat-seal process. If the Mylar film is immediately separated from the first and second air-packing films 171*a*–171*b*, the heat-sealed portions of the air-packing films 171*a*–171*b* may be deformed or even broken.

Thus, in the manufacturing apparatus of FIG. 18, unlike immediately separating the Mylar film from the first and second air-packing films 171*a*–171*b*, the Mylar film moves at the same feed speed of the air-packing films 171*a*–171*b* because of the belt conveyer 277. During this time, the heat seal portions with a high temperature are naturally cured while they are temporarily stuck to the Mylar film on the belt 277*a*. Thus, the first and second air-packing films 171*a*–171*b* can be securely separated from the Mylar film at the end of the belt conveyor 277.

The third stage of the sealing process is performed by the upper-lower heat seal device 276. This is the final heat-seal process in the production process to produce the air-packing device 40 by bonding the films at the heat-seal lands 43. The air-packing devices which are produced in the form of one long sheet may be cut to each sheet of air-packing device 40 such as shown in FIG. 5.

The air-packing device 40 in FIG. 5 produced through the production process and apparatus shown in FIGS. 17 and 18 is folded as described in the foregoing. Then, the post heat-sealing treatment is applied to the air-packing device 40 to create the final form of air-packing device 40 having the cushion portion and the container portion. The air-packing device 40 is inflated by the compressed air before or after loading the product therein.

In the air-packing device described in the foregoing, the heat-seal lands which bond the two layers of plastic films to create folding (bending) locations are formed in a manner shown in FIGS. 5, 11A and 15A. For example, in FIG. 5, the heat-seal lands 43 define the series connected air cells 42 having a sausage like shape, thereby enabling to bend the air-packing device 40 to an appropriate shape for packing the product. The heat-seal lands 43 are created during the process of FIG. 18 which forms the sheet like shape of the air-packing device.

Figure 19A:
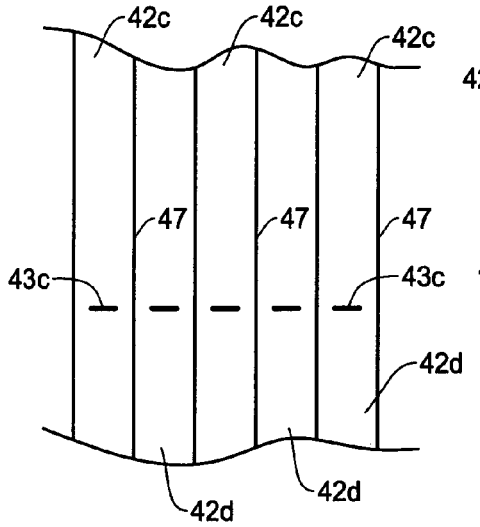
FIGS. 19A–19C are schematic diagrams showing an example of locations of the heat-seal lands on the air-packing device of the present invention where
Figure 19B:
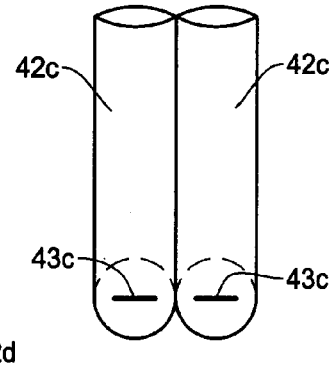
Figure 19C:
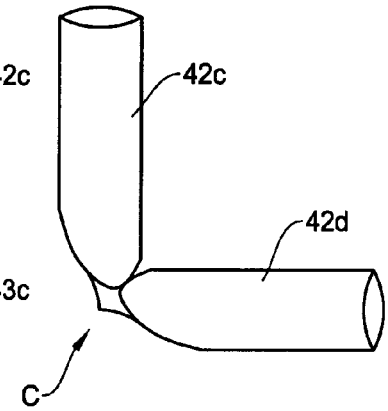

The heat-seal lands in the above example are formed at the center of the air cells. This example is shown in more detail in FIGS. 19A–19C which correspond to the air-packing device 40 shown in FIGS. 4–7. FIG. 19A is a plan view of the air-packing device when it is in the sheet form, FIG. 19B is a plan view of the air-packing device when it is inflated, and FIG. 19C is a side view of the air-packing device when it is inflated. The example of FIGS. 19A–19C show the air cells 42*c*–42*d* and the heat-seal land 43*c* between the air cells 42*c* and 42*d*.

As described with reference to FIG. 5, when the heat-seal land is located at the center of the air cell, the air flows the sides of the air cell toward the next air cell. In this structure, the two air passages of small diameter will be created at both sides of the heat-seal land 43. Since the heat-seal land 43 is closed, when bent as shown in FIG. 19C, the small air passages form a shape of a small bump at the corner C. Thus, the corner C does not have a round shape of sufficient size to contact the inner walls of the container box or absorb an impact from the container box. Thus, the shock absorbing capability at the bending corner C tends to be low because the surface of the corner does not sufficiently contact with the inner walls of the container box. Moreover, it is not aesthetically pleasing because the corner C is not very rounded.

Figure 20A:
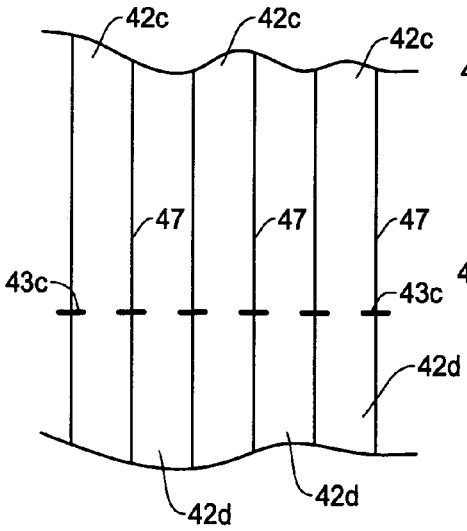
FIGS. 20A–20C are schematic diagrams showing another example of locations of the heat-seal lands on the air-packing device of the present invention where
Figure 20B:
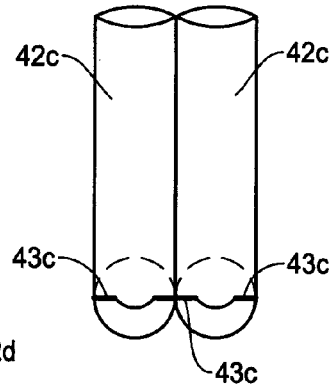
Figure 20C:
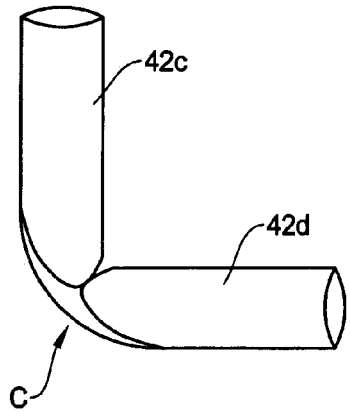

FIGS. 20A–20C are schematic diagrams showing another example of locations of the heat-seal lands on the air-packing device of the present invention where FIG. 20A is a plan view when the air-packing device is in the sheet form, FIG. 20B is a plan view when the air-packing device is inflated, and FIG. 20C is a side view thereof. In this example, the heat-seal lands 43*c* are formed on the boundary 47 which is formed by the bonding the thermoplastic films to separate the series connected air cells. Thus, the air flows through the center of the air cell to the next air cell rather than the side thereof.

For each air cell, since a single air passage is formed at the center, and the heat-seal lands 43*c* are formed on the boundary 47 which is also closed, the air passage has a larger size than that shown in FIGS. 19A–19C. Thus, the corner C of the air-packing device has a smooth and round shape in side view as shown in FIG. 20C. The round corners C tend to more snugly match and contact with the corner and the inner walls of the container box. Thus, this example has a better shock absorbing property that of FIGS. 19A–19C. Further, it creates smooth and round corners that are aesthetically appreciated.

As has been described above, according to the present invention, the air-packing device can minimize a mechanical shock or vibration to the product when a container box carrying the product is dropped or collided. The sheet form of the air-packing device is folded and the post heat-seal treatment is applied thereto, thereby creating a structure unique to a production to be protected. The air-packing device can easily form a cushion portion and a container portion for packing the product by a post heat-sealing treatment where the container portion floatingly supports the product in a container box to absorb the shock applied to the container box. The air-packing device having the double layer cushion portion has a further improved shock absorbing capability.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. An air-packing device inflatable by compressed air for protecting a product therein, comprising:

first and second thermoplastic films superposed with each other where predetermined portions of the first and second thermoplastic films are bonded, thereby creating a plurality of air containers, each of the air containers having a plurality of series connected air cells;

a plurality of check valves established at inputs of the corresponding air containers between the first and second thermoplastic films for allowing the compressed air to flow in a forward direction;

an air input commonly connected to the plurality of check valves to supply the compressed air to all of the series connected air cells through the check valves; and heat-seal flanges that are made of thermoplastic film and are formed on side edges close to both ends of the air-packing device;

wherein, through a post heat-seal treatment, predetermined points on said air containers are bonded with one another, and said heat-seal flanges are bonded with one another, thereby creating a container portion having an opening for packing a product therein and a cushion portion for supporting the container portion when the air-packing device is inflated by the compressed air.

2. An air-packing device as defined in claim 1, wherein said air input and said plurality of check valves are formed at one end of the air-packing device where the air from the air input is supplied to the series connected air cells in a direction toward another end of the air-packing device through the check valves.

3. An air-packing device as defined in claim 1, wherein said cushion portion has a triangular shape where the container portion is formed on a summit of the triangular shape of the cushion portion.

4. An air-packing device as defined in claim 1, wherein said cushion portion has a pentagon shape where the container portion is formed on a summit of the pentagon shape of the cushion portion.

5. An air-packing device as defined in claim 1, wherein said predetermined portions for bonding the first and second thermoplastic films include heat-seal lands each being formed at about a center of the air container to define said air cells, said heat-seal lands are folding points of the air-packing device when the air-packing device is inflated after the post heat-seal process.

6. An air-packing device as defined in claim 5, wherein, each of said heat-seal lands forms two air flow passages at both sides thereof in said air container thereby allowing the compressed air to flow to the series connected air cells through the two air passages.

7. An air-packing device as defined in claim 1, wherein said predetermined portions for bonding the first and second thermoplastic films include heat-seal lands each being formed on a bonding line which air-tightly separates two adjacent air containers to define said air cells, said heat-seal lands are folding points of the air-packing device when the air-packing device is inflated after the post heat-seal process.

8. An air-packing device as defined in claim 7, wherein, each of said heat-seal lands forms an air flow passage at about a center of the air container thereby allowing the compressed air to flow to the series connected air cells through the air passage.

9. An air-packing device as defined in claim 1, wherein, when packing a product to be protected in a container box, said cushion portion of the air-packing device contacts with an inner wall of the container box while the container portion of the air-packing device floatingly supports the product in the air without contacting with inner walls of the container box.

10. An air-packing device as defined in claim 9, wherein said cushion portion has a triangular shape where the container portion is formed on a summit of the triangular shape of the cushion portion, and the air cell forming a base of the triangular shape contacts with the inner walls of the container box.

11. An air-packing device as defined in claim 9, wherein said cushion portion has a pentagon shape where the container portion is formed on a summit of the pentagon shape of the cushion portion, and the air cells forming a base and sides of the pentagon shape contact with the inner walls of the container box.

12. An air-packing device inflatable by compressed air for protecting a product therein, comprising:

first and second thermoplastic films superposed with each other where predetermined portions of the first and second thermoplastic films are bonded, thereby creating a plurality of air containers, each of the air containers having a plurality of series connected air cells;

a plurality of check valves established at inputs of the corresponding air containers between the first and second thermoplastic films for allowing compressed air to flow in a forward direction;

an air input commonly connected to the plurality of check valves to supply the compressed air to all of the series connected air cells through the check valves; and heat-seal flanges that are made of thermoplastic film and are formed on side edges close to both ends and intermediate positions of the air-packing device;

wherein, through a post heat-seal treatment, predetermined points on said air containers are bonded with one another, and said heat-seal flanges are bonded with one another, thereby creating two container portions facing with one another each having an opening for packing a product therein and two cushion portions at opposite ends of the air-packing device for supporting the container portions when the air-packing device is inflated by the compressed air.

13. An air-packing device as defined in claim 12, wherein, when packing a product to be protected in a container box, said two cushion portions of the air-packing device contact with inner walls of the container box while the two container portions of the air-packing device floatingly support the product in the air without contacting with inner walls of the container box.

14. An air-packing device as defined in claim 13, wherein each of said two cushion portions has a triangular shape where the corresponding container portion is formed on a summit of the triangular shape of the cushion portion, and the air cell forming a base of the triangular shape of each of the cushion portion contacts with the corresponding inner wall of the container box.

15. An air-packing device as defined in claim 13, wherein each of said two cushion portions has a pentagon shape where the corresponding container portion is formed on a summit of the pentagon shape of the cushion portion, and the air cells forming a base and sides of the pentagon shape of each of the cushion portion contacts with the corresponding inner walls of the container box.

16. An air-packing device inflatable by compressed air for protecting a product therein, comprising:

first and second thermoplastic films superposed with each other where predetermined portions of the first and second thermoplastic films are bonded, thereby creating a plurality of air containers, each of the air containers having a plurality of series connected air cells;

a plurality of check valves established at inputs of the corresponding air containers between the first and second thermoplastic films for allowing compressed air to flow in a forward direction;

an air input commonly connected to the plurality of check valves to supply the compressed air to all of the series connected air cells through the check valves; and heat-seal flanges that are made of at least one of first and second thermoplastic films and are formed on side edges of the air-packing device;

wherein, said air-packing device in a sheet form is folded in a W-shape in cross section, and through a post heat-seal treatment, predetermined points on said air containers are bonded with one another, and said heat-seal flanges are bonded with one another, thereby creating a container portion having an opening for packing a product therein and a double layer cushion portion at an outer periphery of the container portion when the air-packing device is inflated by the compressed air.

17. An air-packing device as defined in claim 16, wherein said predetermined portions for bonding the first and second thermoplastic films include heat-seal lands each being formed on a predetermined location of the air container to define said air cells, said heat-seal lands are folding points of the air-packing device when the air-packing device is inflated after the post heat-seal process.

18. An air-packing device as defined in claim 16, wherein said double layer cushion portion is configured by outer and inner layers air cells without contacting with each other when the air-packing device is inflated, and wherein the air cells in the outer layer are longer than the air cells in the inner layer.

19. An air-packing device as defined in claim 16, wherein said double layer cushion portion is configured by outer and inner layers air cells without contacting with each other when the air-packing device is inflated, and wherein the air cells in the outer layer are larger in diameter than that of the air cells in the inner layer.

20. An air-packing device as defined in claim 16, wherein, said double layer cushion portion is configured by outer and inner layers air cells without contacting with each other when the air-packing device is inflated, and when packing a product to be protected in a container box, said double layer cushion portion of the air-packing device contacts with an inner wall of the container box while the container portion of the air-packing device floatingly supports the product in the air without contacting with inner walls of the container box.

* * * * *